US007159960B2

(12) United States Patent
Nunokawa et al.

(10) Patent No.: US 7,159,960 B2
(45) Date of Patent: Jan. 9, 2007

(54) LIQUID EJECTING METHOD, LIQUID EJECTING APPARATUS, AND LIQUID EJECTING SYSTEM FOR FORMING DOTS UP TO EDGE OF A MEDIUM

(75) Inventors: Hirokazu Nunokawa, Nagano-ken (JP); Yukimitsu Fujimori, Nagano-ken (JP); Kentaro Tanaka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 210 days.

(21) Appl. No.: 10/850,458

(22) Filed: May 21, 2004

(65) Prior Publication Data

US 2005/0057590 A1 Mar. 17, 2005

(30) Foreign Application Priority Data

May 22, 2003 (JP) ..... 2003-144314

(51) Int. Cl.
*B41J 29/38* (2006.01)

(52) U.S. Cl. ..... 347/14; 347/16
(58) Field of Classification Search ..... 347/14; *B41J 29/38*
See application file for complete search history.

(56) References Cited

U.S. PATENT DOCUMENTS

| | | | | |
|---|---|---|---|---|
| 6,109,745 | A * | 8/2000 | Wen | 347/101 |
| 6,239,817 | B1 * | 5/2001 | Meyer | 347/36 |
| 6,517,267 | B1 * | 2/2003 | Otsuki | 400/124.01 |
| 2002/0057312 | A1 * | 5/2002 | Watanabe et al. | 347/56 |
| 2003/0016264 | A1 * | 1/2003 | Jeanmaire | 347/28 |
| 2004/0017421 | A1 * | 1/2004 | Jeanmaire | 347/22 |
| 2005/0185039 | A1 * | 8/2005 | Garbacz | 347/101 |

FOREIGN PATENT DOCUMENTS

JP 2002-103586 A 4/2002

* cited by examiner

*Primary Examiner*—Stephen Meier
*Assistant Examiner*—Rene Garcia, Jr.
(74) *Attorney, Agent, or Firm*—Sughrue Mion, PLLC

(57) ABSTRACT

Liquid droplets, which are ejected toward a region that is outside of a medium, are to be prevented from floating and liquid droplets are to be inhibited from adhering to unanticipated sites when ejecting droplets of liquid to form dots up to the edges of a medium. In a liquid ejecting apparatus provided with a liquid ejecting section for ejecting liquid droplets of a plurality of sizes toward a medium, the liquid ejecting section ejects liquid droplets toward the medium, and the liquid droplets of the smallest size of the liquid droplets, among a plurality of sizes, are not included in the liquid droplets that are outside of and that do not land on the medium.

11 Claims, 21 Drawing Sheets

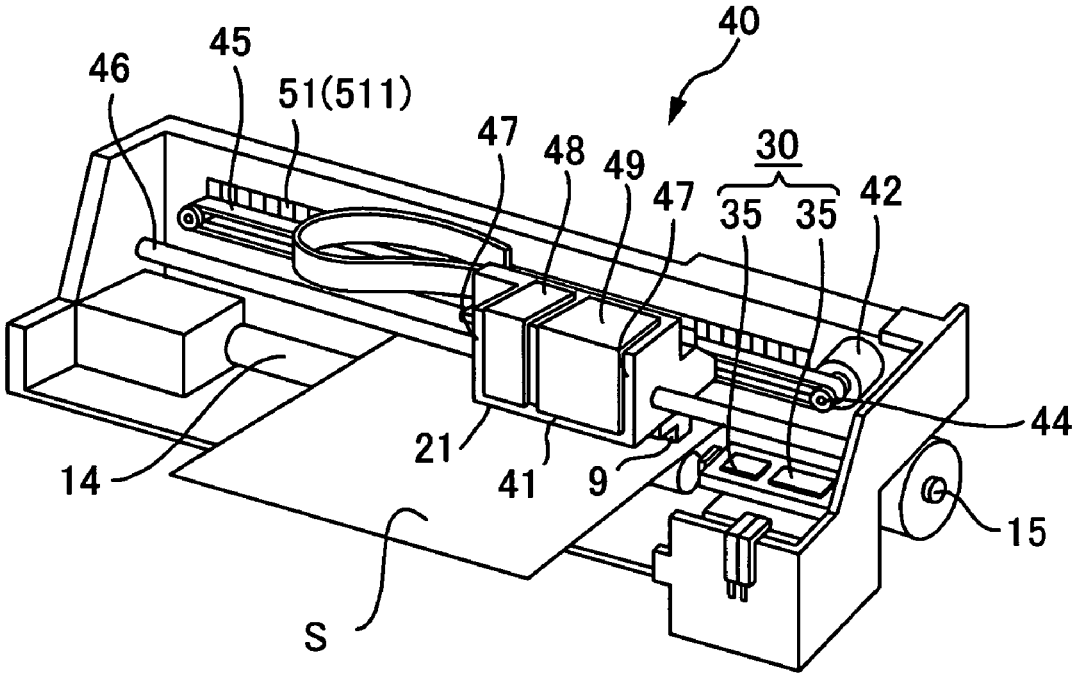
FIG. 3
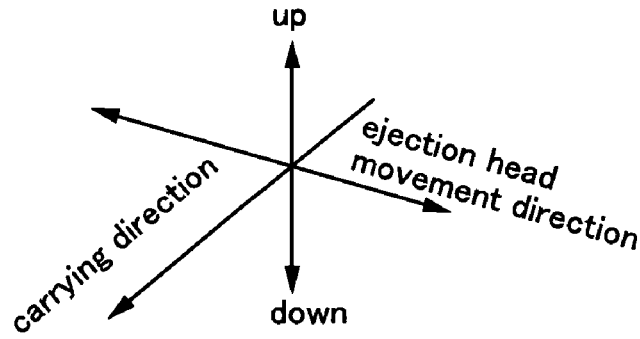

LIQUID EJECTING METHOD, LIQUID EJECTING APPARATUS, AND LIQUID EJECTING SYSTEM FOR FORMING DOTS UP TO EDGE OF A MEDIUM

CROSS-REFERENCE TO RELATED APPLICATIONS

The present application claims priority upon Japanese Patent Application No. 2003-144314 filed on May 22, 2003, which is herein incorporated by reference.

BACKGROUND OF THE INVENTION

1. Field of the Invention

The present invention relates to liquid ejecting methods, liquid ejecting apparatuses, and liquid ejecting systems for ejecting liquid droplets toward a medium.

2. Description of the Related Art

Inkjet printers are known as one type of liquid ejecting apparatus for ejecting liquid droplets toward a medium. Such inkjet printers eject ink droplets as the liquid droplets toward print paper (hereinafter, also referred to as paper) serving as a medium to form numerous dots on the paper, printing a macroscopic image through these dots.

Such inkjet printers are provided with a print function known as "borderless printing." This is the function of printing an image on paper, without forming margins, by forming dots over the entire paper up to its edges. Ordinarily, by using image data that is larger in size than the paper, ink droplets are ejected toward regions outside the paper as well so that unexpected areas in which no dots are formed are kept from occurring in the edges due to, for example, misalignment during carrying of the paper.

Also, in a platen serving as a support member that supports the paper while ink droplets land on the paper, an ink collecting section for collecting ink droplets that have landed outside the paper and abandoned is formed as a groove, and the abandoned ink droplets are absorbed and retained by an absorbing material such as a sponge provided in the ink collecting section.

However, when the ink droplets are small in size, the velocity at which the ink droplets are ejected is reduced due, for example, to air resistance before they reach the ink collecting section, thereby potentially causing the ink droplets to lose speed and float. Then, depending on the conditions such as the airflow and the static electricity inside the printer, the ink droplets may adhere to the platen when they have finished floating, causing the platen, which should be clean, to become dirty.

SUMMARY OF THE INVENTION

The present invention was arrived in light of the foregoing matters, and it is an object thereof to provide a liquid ejecting method, a liquid ejecting apparatus, and a liquid ejecting system capable of preventing liquid droplets that are ejected toward a region that is outside of a medium from floating and thereby inhibiting liquid droplets from adhering to unanticipated sites when ejecting droplets of liquid to form dots up to the edges of a medium.

A main aspect of the present invention is a liquid ejecting method such as the following.

A liquid ejecting method comprises the following steps of:

preparing a medium; and ejecting liquid droplets of a plurality of sizes toward the medium that has been prepared;

wherein liquid droplets of the smallest size, among the liquid droplets of the plurality of sizes, are not included in the liquid droplets that are outside of and that do not land on the medium.

Further, another main aspect of the present invention is a liquid ejecting method such as the following.

A liquid ejecting method comprises the following steps of:

preparing a medium; and ejecting liquid droplets toward the medium that has been prepared;

wherein liquid droplets that have been changed from the smallest size to a larger size and ejected are included in the liquid droplets that are outside of and that do not land on the medium.

Further, another main aspect of the present invention is a liquid ejecting apparatus such as the following.

A liquid ejecting apparatus comprises:

a liquid ejecting section for ejecting liquid droplets of a plurality of sizes toward a medium; and a controller for controlling ejection of the liquid droplets from the liquid ejecting section;

wherein the controller controls ejection of the liquid droplets from the liquid ejecting section such that liquid droplets of the smallest size, among the liquid droplets of the plurality of sizes, are not included in the liquid droplets that are outside of and that do not land on the medium.

Further, another main aspect of the present invention is a liquid ejecting apparatus such as the following.

A liquid ejecting apparatus comprises:

a liquid ejecting section for ejecting liquid droplets of a plurality of sizes toward a medium; and a controller for controlling ejection of the liquid droplets from the liquid ejecting section;

wherein the controller controls ejection of the liquid droplets from the liquid ejecting section such that liquid droplets that have been changed from the smallest size to a larger size and ejected are included in the liquid droplets that are outside of and that do not land on the medium.

Further, another main aspect of the present invention is a liquid ejecting system such as the following.

A liquid ejecting system comprises:

a main computer unit; and a liquid ejecting apparatus that is connected to the main computer unit in a manner that allows for communication therebetween;

wherein the liquid ejecting apparatus is provided with a liquid ejecting section for ejecting liquid droplets of a plurality of sizes toward a medium in accordance with data that is received from the main computer unit; and wherein, when the liquid droplets are to be ejected from the liquid ejecting section toward the medium, the liquid ejecting apparatus receives data of a configuration according to which liquid droplets of the smallest size, among the liquid droplets of the plurality of sizes, are not included in the liquid droplets that are outside of and that do not land on the medium.

Other features of the present invention will become clearer through the accompanying drawings and the following description.

BRIEF DESCRIPTION OF THE DRAWINGS

For a more complete understanding of the present invention and the advantages thereof, reference is now made to the following description taken in conjunction with the accompanying drawings.

FIG. 3 is a diagram showing the carriage etc. of the inkjet printer.

DETAILED DESCRIPTION OF PREFERRED EMBODIMENTS

Figure 1:
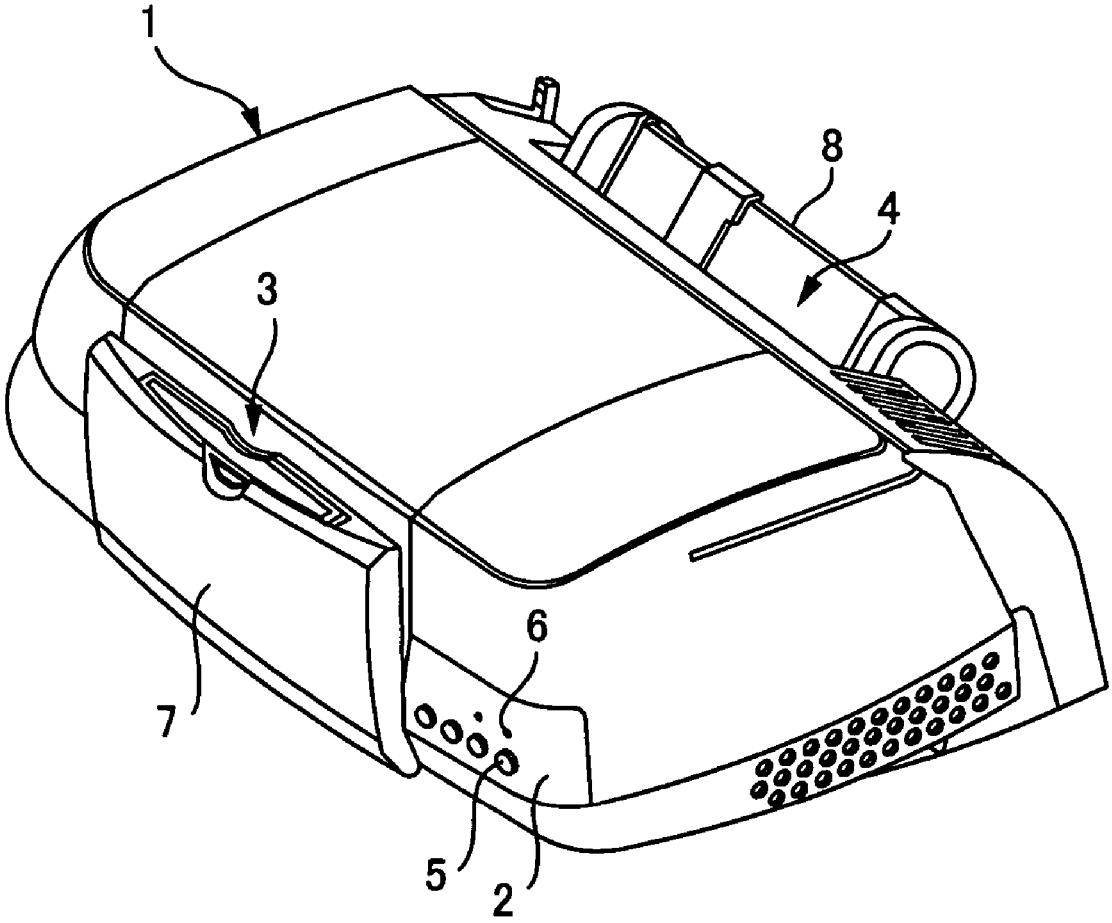
FIG. 1 is a perspective view showing an embodiment of an inkjet printer.

At least the following matters will be made clear by the present specification and the description of the accompanying drawings.

A liquid ejecting method comprises the following steps of:

preparing a medium; and ejecting liquid droplets of a plurality of sizes toward the medium that has been prepared;

wherein liquid droplets of the smallest size, among the liquid droplets of the plurality of sizes, are not included in the liquid droplets that are outside of and that do not land on the medium.

According to this liquid ejecting method, liquid droplets are ejected toward the medium, and liquid droplets of the smallest size are not included in the liquid droplets that are outside of and that do not land on the medium. Thus, the floating of liquid droplets due to a drop in speed after ejection, which is prone to occur with liquid droplets of the smallest size, can be reliably prevented, and as a result, the adhering of such floating liquid droplets to unanticipated sites can be reliably prevented.

Further, it is possible that the liquid droplets of the smallest size are not ejected when at least one or more liquid droplets are ejected toward a region that is determined to be outside of the medium.

According to this liquid ejecting method, liquid droplets are not ejected toward the region that is determined to be outside of the medium. Thus, the floating of liquid droplets due to a drop in speed after ejection, which is prone to occur with liquid droplets of the smallest size, can be reliably prevented, and as a result, the adhering of such floating liquid droplets to unanticipated sites can be reliably prevented.

Further, the liquid droplets may be ejected in accordance with a plurality of drive signals that are prepared corresponding respectively to the sizes of the liquid droplets; and the liquid droplets of the smallest size may be liquid droplets of a size that corresponds to a predetermined type of drive signal among the drive signals.

According to this liquid ejecting method, the size of liquid droplets can be adjusted in accordance with a setting of the drive signals.

Further, the liquid droplets may be ejected in accordance with image data formed at a size larger than the medium, and a reference region corresponding to the size of the medium may be stored in a memory; and the region that is determined to be outside of the medium may be a region that is outside of the reference region.

According to this liquid ejecting method, an image can be formed even up to the edges of a medium. That is, an image can be formed without borders.

Further, an edge section having a predetermined width may be established within the reference region along an outline of the reference region, and a proportion of the liquid droplets of the smallest size, among the liquid droplets that are ejected toward the edge section, decreases toward the outside in the direction of the width.

According to this liquid ejecting method, the edge sections function as a buffer region for lowering the proportion of ink droplets of the smallest size. Thus, it is possible to keep the difference in image quality between outside of the reference region and inside of the reference region from standing out.

Further, data for ejecting liquid droplets other than the liquid droplets of the smallest size may be recorded on a section of the image data that corresponds to the region that is outside of the reference region.

According to this liquid ejecting method, when liquid droplets are ejected according to the image data, then liquid droplets of the smallest size are not ejected toward the region that is determined to be outside of the medium. Thus, the adhering of floating liquid droplets to unanticipated sites can be reliably prevented.

Further, the medium may be supported by a support member when the liquid droplets that are ejected from the liquid ejecting section land on the medium; and a recessed section may be formed in the support member in correspondence with a region that is determined to be outside of the medium, and the medium may be supported by a protruding section of the support member.

According to this liquid ejecting method, liquid droplets that have been ejected toward the region that is determined to be outside of the medium are collected in the recessed section, and the medium is supported by the protruding section. Thus, the medium is prevented from being dirtied by liquid droplets that have been ejected toward the region that is determined to be outside of the medium.

Further, the liquid droplets may be ink droplets.

According to this liquid ejecting method, it is possible to print on a medium using ink.

A liquid ejecting method comprises the following steps of:

preparing a medium; and ejecting liquid droplets toward the medium that has been prepared;

wherein liquid droplets that have been changed from the smallest size to a larger size and ejected are included in the liquid droplets that are outside of and that do not land on the medium.

According to this liquid ejecting method, liquid droplets that have been changed from the smallest size to a larger size and ejected are included in the liquid droplets that are outside of and that do not land on the medium. Therefore, the number of liquid droplets of the smallest size, among liquid droplets that have not landed, can be reduced, thereby allowing the quantity of liquid droplets that float as a result of a drop in speed after ejection, which is prone to occur with liquid droplets of the smallest size, to be reduced. Thus, the adhering of floated liquid droplets to unanticipated sites can be inhibited.

Further, when liquid droplets of the smallest size are to be ejected toward a region that is determined to be outside of the medium, at least one of the liquid droplets of the smallest size that are to be ejected may be changed to a liquid droplet of a larger size and ejected.

According to this liquid ejecting method, at least one of the liquid droplets of the smallest size that are to be ejected is changed to a liquid droplet of a larger size and ejected when liquid droplets of the smallest size are to be ejected toward the region. Therefore, the number of liquid droplets that are ejected toward the region is reduced, thereby allowing the quantity of liquid droplets that are floated as a result of a drop in speed after ejection, which is prone to occur with liquid droplets of the smallest size, to be reduced. Thus, the adhering of floated liquid droplets to unanticipated sites can be inhibited.

The following liquid ejecting apparatus can also be achieved.

A liquid ejecting apparatus comprises:

a liquid ejecting section for ejecting liquid droplets of a plurality of sizes toward a medium; and a controller for controlling ejection of the liquid droplets from the liquid ejecting section;

wherein the controller controls ejection of the liquid droplets from the liquid ejecting section such that liquid droplets of the smallest size, among the liquid droplets of the plurality of sizes, are not included in the liquid droplets that are outside of and that do not land on the medium.

The following liquid ejecting apparatus can also be achieved.

A liquid ejecting apparatus comprises:

a liquid ejecting section for ejecting liquid droplets of a plurality of sizes toward a medium; and a controller for controlling ejection of the liquid droplets from the liquid ejecting section;

wherein the controller controls ejection of the liquid droplets from the liquid ejecting section such that liquid droplets that have been changed from the smallest size to a larger size and ejected are included in the liquid droplets that are outside of and that do not land on the medium.

The following liquid ejecting system can also be achieved.

A liquid ejecting system comprises:

a main computer unit; and a liquid ejecting apparatus that is connected to the main computer unit in a manner that allows for communication therebetween;

wherein the liquid ejecting apparatus is provided with a liquid ejecting section for ejecting liquid droplets of a plurality of sizes toward a medium in accordance with data that is received from the main computer unit; and wherein, when the liquid droplets are to be ejected from the liquid ejecting section toward the medium, the liquid ejecting apparatus receives data of a configuration according to which liquid droplets of the smallest size, among the liquid droplets of the plurality of sizes, are not included in the liquid droplets that are outside of and that do not land on the medium.

Overview of the Liquid Ejecting Apparatus

Figure 2:
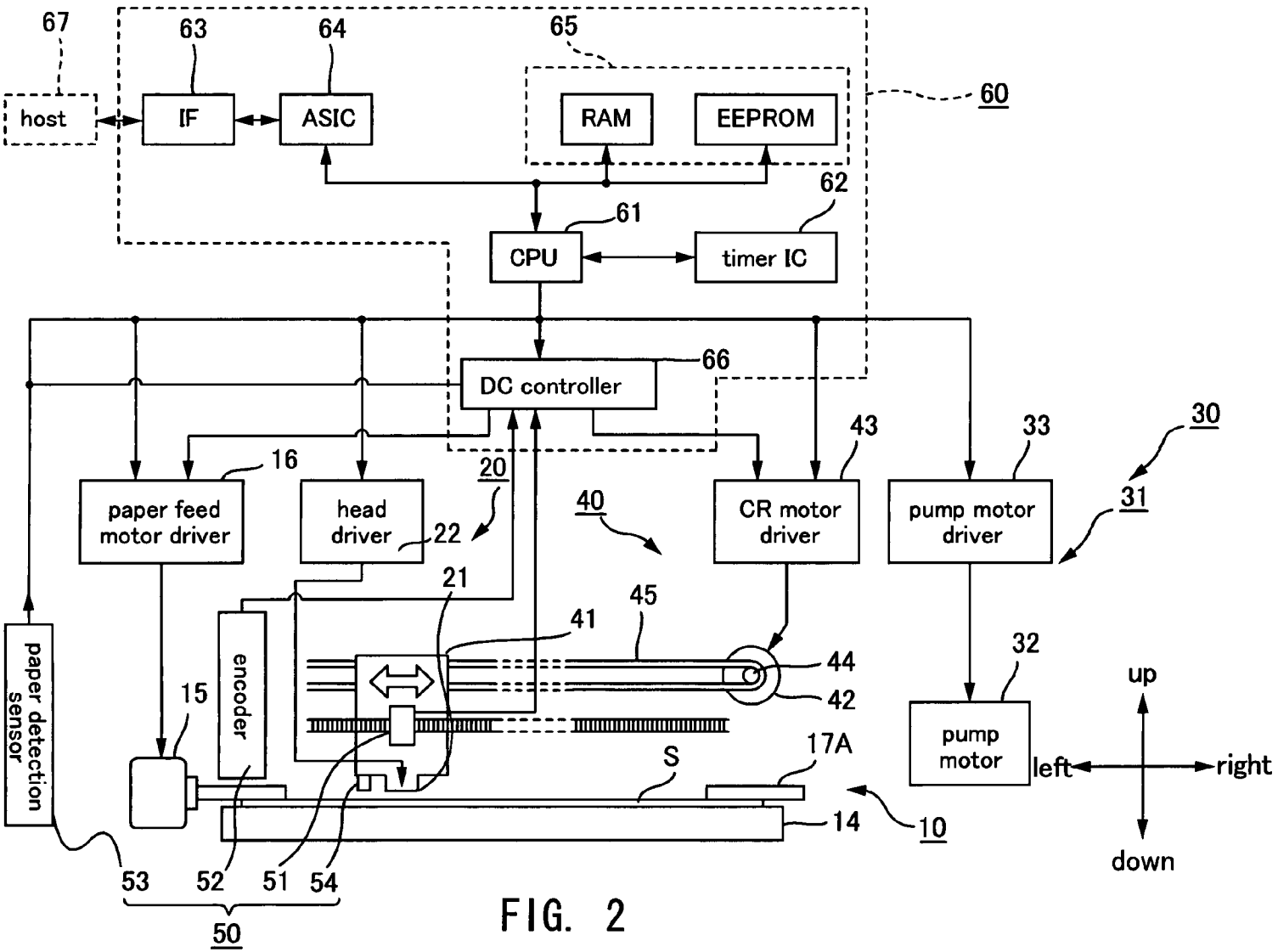
FIG. 2 is an explanatory diagram of the overall configuration of the inkjet printer.
Figure 4:
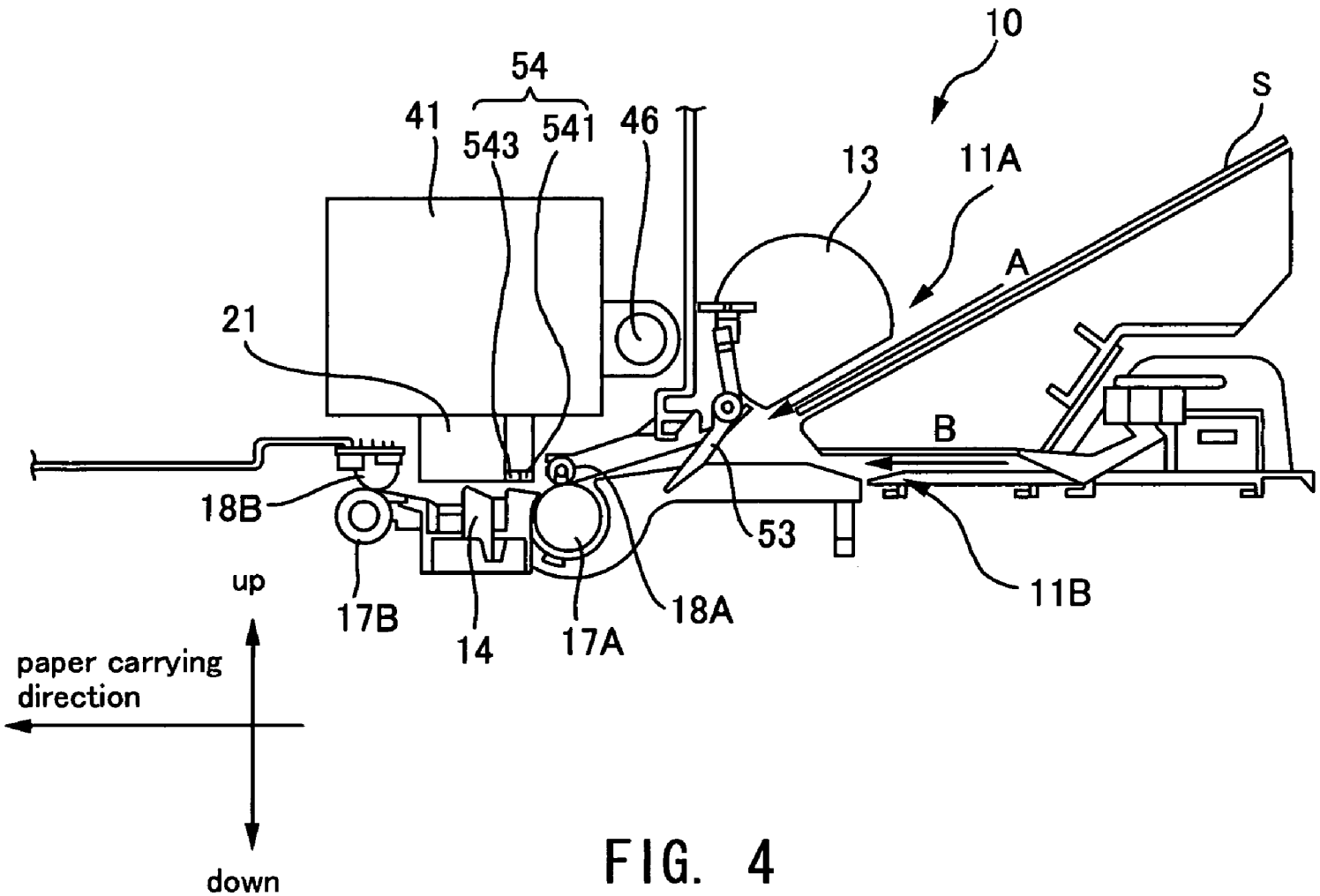
FIG. 4 is a diagram showing the carrying mechanism of the inkjet printer.

An overview of an inkjet printer serving as an example of a liquid ejecting apparatus according to the present invention is described. FIG. 1 to FIG. 4 are diagrams for describing the overview of one embodiment of an inkjet printer 1. FIG. 1 shows the external appearance of the embodiment of the inkjet printer 1, FIG. 2 shows a block configuration of the inkjet printer 1, FIG. 3 shows a carriage, and its periphery, of the inkjet printer 1, and FIG. 4 shows a carry section, and its periphery, of the inkjet printer 1.

As shown in FIG. 1, the inkjet printer 1 is provided with a structure for discharging from its front side a print paper S serving as a medium that is supplied from its rear side. On its front side, the inkjet printer 1 is provided with a control panel 2 and a paper discharge section 3, and on its rear side it is provided with a paper feed section 4. The control panel 2 is provided with various types of control buttons 5 and display lamps 6. The paper discharge section 3 is provided with a paper discharge tray 7 that blocks the paper discharge opening when the inkjet printer is not used. The paper feed section 4 is provided with a paper feed tray 8 for holding cut paper (not shown). It should be noted that the inkjet printer 1 can also be provided with a paper feed structure with which it is possible to print not only the single sheets of the paper S, such as cut paper, but also a continuous medium such as roll paper.

As shown in FIG. 2, the inkjet printer 1 is provided with a paper carrying unit 10, an ink ejection unit 20, a cleaning unit 30, a carriage unit 40, a measuring instrument group 50, and a control unit 60 as its primary components.

The paper carrying unit 10 is for feeding the paper S to a printable position and moving the paper S in a predetermined direction (the direction perpendicular to the paper face in FIG. 2 (hereinafter, referred to as the paper carrying direction)) by a predetermined movement amount during printing. In other words, the paper carrying unit 10 functions as a carrying mechanism for carrying the paper S. As shown in FIG. 4, the paper carrying unit 10 has a paper insert opening 11A and a roll paper insert opening 11B, a paper supply motor (not shown), a paper supply roller 13, a platen 14, a paper feed motor (hereinafter, referred to as PF motor) 15, a paper feed motor driver (hereinafter, referred to as PF motor driver) 16, a carry roller 17A and paper discharge rollers 17B, and free rollers 18A and free rollers 18B. However, the paper carrying unit 10 does not necessarily have to include all of these structural elements in order to function as a carrying mechanism.

The paper insert opening 11A is where the paper S is inserted. The paper supply motor (not shown) is a motor for carrying the paper S that has been inserted into the paper insert opening 11A into the printer 1, and is constituted by a pulse motor. The paper supply roller 13 is a roller for automatically carrying the paper S that has been inserted into the paper insert opening 11A into the printer 1, and is driven by the paper supply motor 12. The paper supply roller 13 has a transverse cross-sectional shape that is substantially the shape of the letter D. The peripheral length of the circumference section of the paper supply roller 13 is set longer than the carrying distance to the PF motor 15, so that using this circumference section the paper S can be carried up to the PF motor 15. It should be noted that a plurality of media are kept from being supplied at one time by the rotational drive force of the paper supply roller 13 and the friction resistance of separating pads (not shown).

The platen 14 is a support member that supports the paper S during printing. The PF motor 15 is a motor for feeding the paper S in the paper carrying direction, as shown in FIG. 2 and FIG. 3, and is constituted by a DC motor. The PF motor driver 16 is for driving the PF motor 15. The carry roller 17A is a roller for feeding the paper S that has been carried into the printer by the paper supply roller 13 to a printable region, and is driven by the PF motor 15. The free rollers 18A (see FIG. 4) are provided in a position that is in opposition to the carry roller 17A, and push the paper S toward the carry roller 17A by sandwiching the paper S between them and the carry roller 17A.

The paper discharge rollers 17B (see FIG. 4) are rollers for discharging the paper S for which printing has finished to outside the printer. The paper discharge rollers 17B are driven by the PF motor 15 through a gear wheel that is not shown in the drawings. The free rollers 18B are provided in a position that is in opposition to the paper discharge rollers 17B, and push the paper S toward the paper discharge rollers 17B by sandwiching the paper S between them and the paper discharge rollers 17B.

The ink ejection unit 20 is for ejecting ink onto the paper S. As shown in FIG. 2, the ink ejection unit 20 has an ejection head 21 and a head driver 22. The ejection head 21 has a plurality of nozzles, which are liquid ejecting sections, and ejects ink droplets intermittently from the nozzles. The head driver 22 is for driving the ejection head 21 so that ink droplets are ejected intermittently from the ejection head 21.

The cleaning unit 30 is for keeping the nozzles of the ejection head 21 from becoming clogged, as shown in FIG. 3 also. The cleaning unit 30 has a pump device 31 and a capping device 35. The pump device 31 is for extracting ink from the nozzles in order to prevent the nozzles from becoming clogged, and has a pump motor 32 and a pump motor driver 33. The pump motor 32 sucks out ink from the nozzles of the ejection head 21. The pump motor driver 33 drives the pump motor 32. The capping device 35 is for sealing the nozzles of the ejection head 21 during standby, that is, when printing is not being performed, so that the nozzles of the ejection head 21 are kept from becoming clogged.

The carriage unit 40 is for moving the ejection head 21 in a predetermined direction (in FIG. 2, the left to right direction of the paper face (hereinafter, this is referred to as the ejection head movement direction)), as shown in FIGS. 2 and 3. It should be noted that the ejection head movement direction is perpendicular to the paper carrying direction. The carriage unit 40 has a carriage 41, a carriage motor (hereinafter, referred to as CR motor) 42, a carriage motor driver (hereinafter, referred to as CR motor driver) 43, a pulley 44, a timing belt 45, and a guide rail 46. The carriage 41 can be moved in the ejection head movement direction, and the ejection head 21 is fastened to it. Thus, the nozzles of the ejection head 21 intermittently eject ink as they are moved in the ejection head movement direction. The carriage 41 also removably holds ink cartridges 48 and 49, which contain ink. The CR motor 42 is a motor for moving the carriage 41 in the ejection head movement direction, and is constituted by a DC motor. The CR motor driver 43 is for driving the CR motor 42. The pulley 44 is attached to the rotation shaft of the CR motor 42. The timing belt 45 is driven by the pulley 44. The guide rail 46 is for guiding the carriage 41 in the ejection head movement direction.

The measuring instrument group 50 includes a linear encoder 51, a rotary encoder 52, a paper detection sensor 53, and a paper width sensor 54. The linear encoder 51 is for detecting the position of the carriage 41. The rotary encoder 52 is for detecting the amount of rotation of the carry roller 17A. The paper detection sensor 53 is for detecting the position of the front end of the paper S to be printed. As shown in FIG. 4, the paper detection sensor 53 is provided in a position where it can detect the position of the front end of the paper S as the paper S is being carried toward the carry roller 17A by the paper supply roller 13. It should be noted that the paper detection sensor 53 is a mechanical sensor that detects the front end of the paper S through a mechanical mechanism. More specifically, the paper detection sensor 53 has a lever that can be rotated in the paper carrying direction, and this lever is disposed so that it protrudes into the path over which the paper S is carried. Thus, the front end of the paper S comes into contact with the lever and the lever is rotated, and thus the paper detection sensor 53 detects the position of the front end of the paper S by detecting the movement of the lever. The paper width sensor 54 is attached to the carriage 41. The paper width sensor 54 is an optical sensor having a light-emitting section 541 and a light-receiving section 543, and detects whether the paper S is in the position of the paper width sensor 54 by detecting light that is reflected by the paper S. The paper width sensor 54 detects the positions of the edges of the paper S while being moved by the carriage 41, so as to detect the width of the paper S. The paper width sensor 54 also can detect the front end of the paper S through the position of the carriage 41. The paper width sensor 54 is an optical sensor, and thus detects positions with higher precision than the paper detection sensor 53.

The control unit 60 is for performing control of the printer. As shown in FIG. 2, the control unit 60 has a CPU 61, a timer 62, an interface section 63, an ASIC 64, a memory 65, and a DC controller 66. The CPU 61 is for performing the overall control of the printer, and sends control commands to the DC controller 66, the PF motor driver 16, the CR motor driver 43, the pump motor driver 32, and the head driver 22. The timer 62 periodically generates interrupt signals for the CPU 61. The interface section 63 exchanges data with a host computer 67 provided outside the printer. The ASIC 64 controls the printing resolution and the drive waveforms of the ejection head, for example, based on printing information sent from the host computer 67 through the interface section 63. The memory 65 is for reserving an area for storing the programs for the ASIC 64 and the CPU 61 and a working area, for example, and has storage means such as a RAM or an EEPROM. The DC controller 66 controls the PF motor driver 16 and the CR motor driver 43 based on control commands sent from the CPU 61 and the output from the measuring instrument group 50.

In such an inkjet printer 1, when printing, the paper S is carried intermittently by the carry roller 17A by a predetermined carry amount, and when stopped, that is, during the break between these intermittent carries, the carriage 41 ejects ink droplets toward the paper S from the ejection head 21 while moving in the direction perpendicular to the carrying direction by the carry roller 17A, that is, in the ejection head movement direction. The ink droplets that have been ejected form dots on the paper S, and numerous dots are formed to produce a macroscopic image on the paper S.

Regarding the Ejection Head

<Nozzle Arrangement in the Ejection Head>

Figure 5:
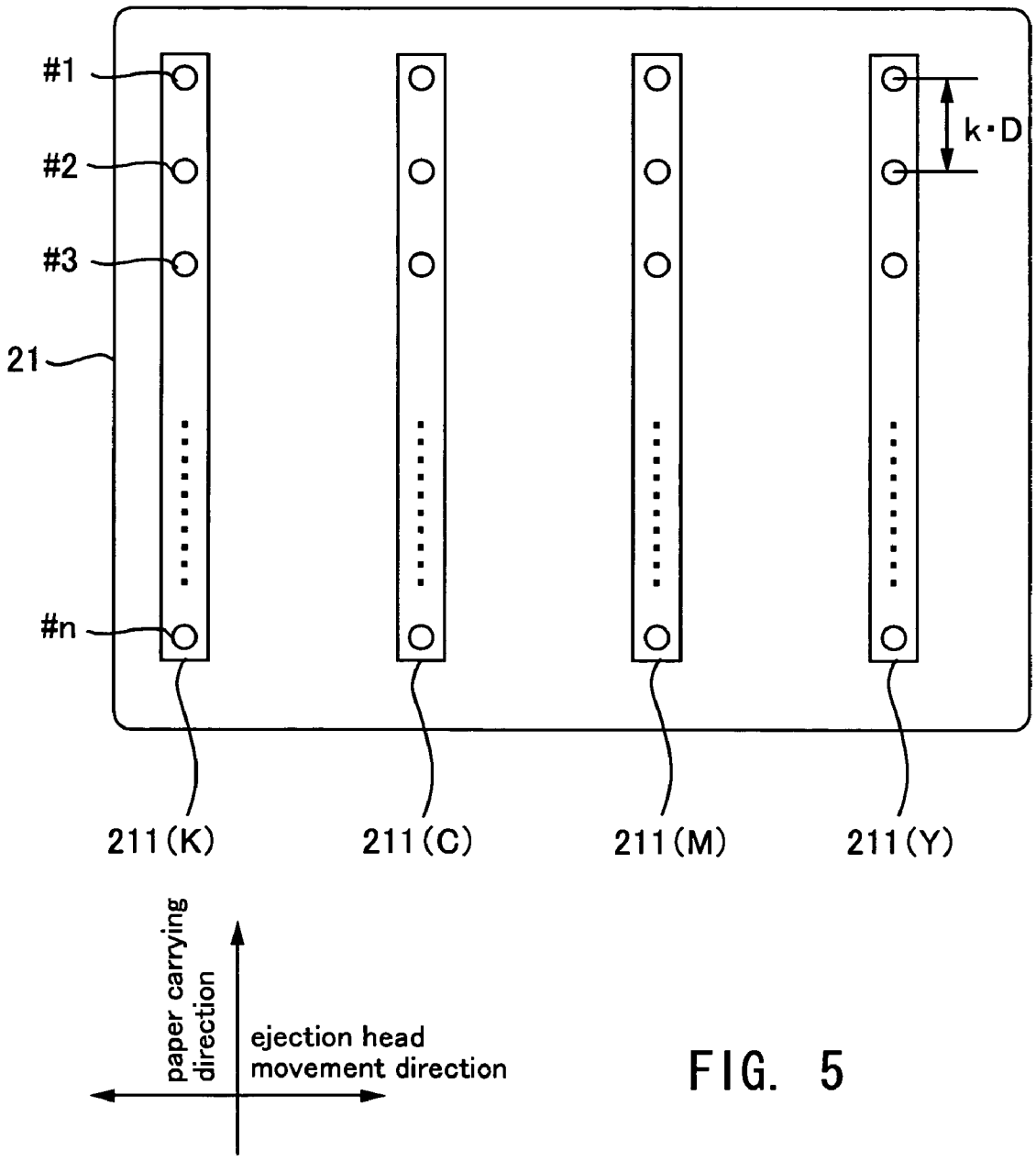
FIG. 5 is an explanatory diagram that shows the arrangement of nozzles in an ejection head.

FIG. 5 is a diagram showing the arrangement of the nozzles for ejecting ink droplets that are provided in the lower surface portion of the ejection head 21. As shown in the diagram, nozzle rows 211 for the colors of black (K), cyan (C), magenta (M), and yellow (Y) are provided in the lower surface portion of the ejection head 21.

Each nozzle row 211 is constituted by a plurality of nozzles #1 to #n. The plurality of nozzles #1 to #n are arranged at a constant spacing (nozzle pitch: k·D) on a straight line in the direction in which the paper S is carried. Here, D is the minimum dot pitch in the carrying direction (that is, the spacing at the highest resolution of the dots formed on the paper S). Also, k is an integer of 1 or more. It should be noted that the nozzles of the nozzle rows are assigned numbers that become smaller toward the downstream side (#1 to #n). Also, the nozzle rows 211 are arranged parallel to one another, with a space between them, in the ejection head movement direction, which is the direction in which the ejection head 21 is moved.

Each of the nozzles #1 to #n is provided with a piezo element (not shown) as a drive element that is used to eject ink droplets. When a voltage of a predetermined duration is applied between electrodes provided on both ends of the piezo element, the piezo element expands in accordance with the voltage application time and deforms the lateral walls of a channel for the ink. Thus, the volume of the ink channel is constricted in correspondence with the expansion of the piezo element, causing an amount of ink that corresponds to the amount of the constriction to be ejected as ink droplets from the nozzles #1 to #n for each color.

<Driving the Nozzles #1 to #n of the Ejection Head>

Figure 6:
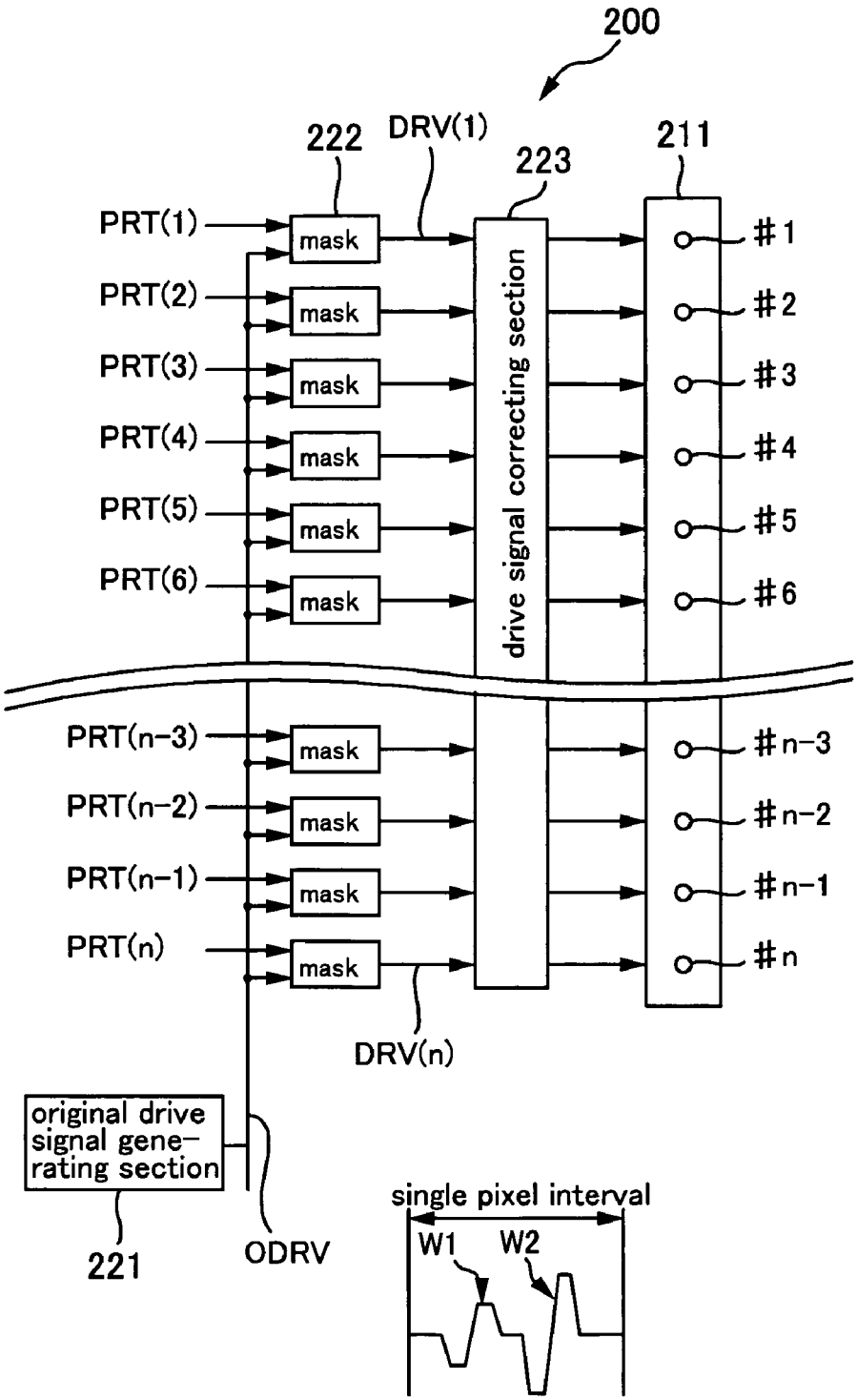
FIG. 6 is a block diagram for a drive signal generating section.
Figure 7:
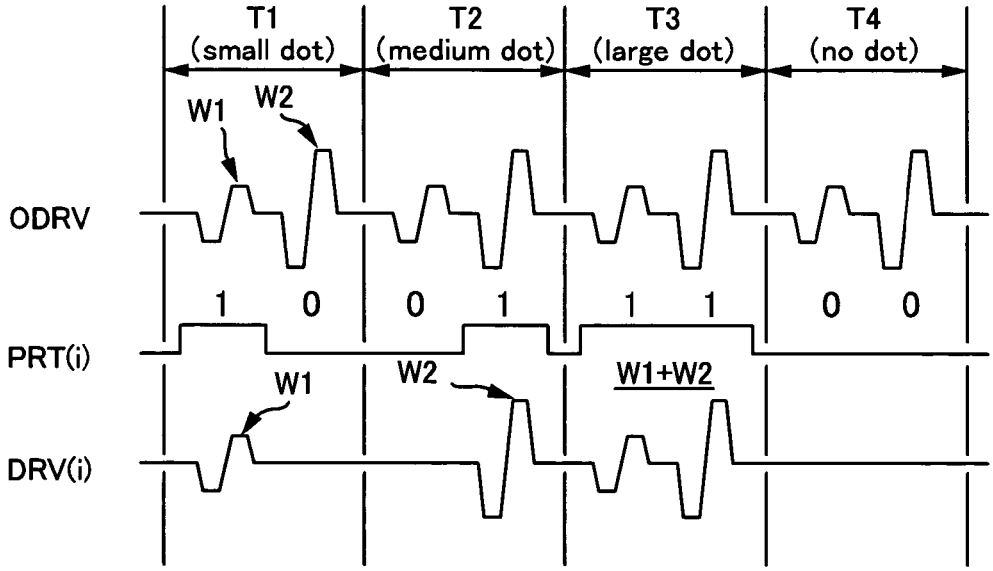
FIG. 7 is a timing chart showing the operation of the drive signal generating section.

FIG. 6 is a block diagram for a drive signal generating section 200 for driving the nozzles #1 to #n of the ejection head 21. Further, FIG. 7 is a timing chart for an original signal ODRV, a print signal PRT(i), and a drive signal DRV(i), which indicate the operation of the drive signal generating section 200.

A drive signal generating section 200 is provided in the head driver 22 shown in FIG. 2 for each of the four nozzle rows. As shown in FIG. 6, each drive signal generating section 200 is provided with a plurality of mask circuits 222, an original drive signal generating section 221, and a drive signal correcting section 223. The mask circuits 222 are provided corresponding to the plurality of piezo elements for driving the nozzles #1 to #n of the ejection head 21. It should be noted that in FIG. 6 the number in parentheses at the end of the name of each of the signals indicates the number of the nozzle to which that signal is supplied.

The original drive signal generating section 221 creates an original drive signal ODRV that is used in common among the nozzles #1 to #n. The original drive signal ODRV is a signal that includes two pulses, these being a first pulse W1 and a second pulse W2, during the period of movement for a single pixel.

The drive signal correcting section 223 performs correction by shifting the timing of the drive signal waveform that is shaped by the mask circuits 222 forward or backward over the entire return pass. By correcting the timing of the drive signal waveform, discrepancies in the positions where ink droplets land in the forward pass and the return pass are corrected, that is, discrepancies in the positions where dots are formed in the forward and return passes are corrected.

As shown in FIG. 6, print signals PRT(i) that are received are input to the mask circuits 222 together with the original drive signal ODRV that is output from the original drive signal generating section 221. The print signals PRT(i) are serial signals having two bits per pixel, and the bits correspond to the first pulse W1 and the second pulse W2, respectively. The mask circuits 222 are gates for masking the original drive signal ODRV depending on the level of the print signals PRT(i). That is, when a print signal PRT(i) is level 1, the mask circuit 222 allows the pulses corresponding to the original signal ODRV to pass unchanged and supplies them to the piezo element as the drive signal DRV. On the other hand, when the print signal PRT(i) is level 0, then the mask circuit 222 blocks the pulses corresponding to the original drive signal ODRV.

As shown in FIG. 7, the original drive signal ODRV generates a first pulse W1 and a second pulse W2 in that order during each pixel interval T1, T2, T3, and T4. It should be noted that "pixel interval" means the period of movement for a single pixel. As shown in the diagram, when the print signal PRT(i) corresponds to the two bits of pixel data "1,0", only the first pulse W1 is output in the first half of the pixel interval. Accordingly, a small-sized ink droplet (small ink droplet) is ejected from the nozzle, forming a small-sized dot (small dot) on the paper S. When the print signal PRT(i) corresponds to the two bits of pixel data "0,1" then only the second pulse W2 is output in the second half of the pixel interval. Accordingly, a medium-sized ink droplet (medium ink droplet) is ejected from the nozzle, forming a medium-sized dot (medium dot) on the paper S. When the print signal PRT(i) corresponds to the two bits of pixel data "1,1" then both the first pulse W1 and the second pulse W2 are output during the pixel interval. Accordingly, one each of a small ink droplet and a medium ink droplet are ejected from the nozzle, forming a large-sized dot (large dot) on the paper S. Also, when the print signal PRT(i) corresponds to the two bits of pixel data "0,0" then neither the first pulse W1 nor the second pulse W2 is output during the pixel interval. In this case, an ink droplet is not ejected from the nozzle, and a dot is not formed on the paper S.

As described above, the drive signal DRV(i) in a single pixel interval is shaped so that it may have four different waveforms corresponding to the four different values of the print signal PRT(i). One of these waveforms is for not causing an ink droplet to be ejected and a dot to be formed, whereas the other three waveforms are for forming dots of three different sizes, these being small, medium, and large, by setting the size of the ink droplets to two levels, small or medium, and ejecting the small and the medium ink droplets independently or together.

Processing in the Host

Figure 8:
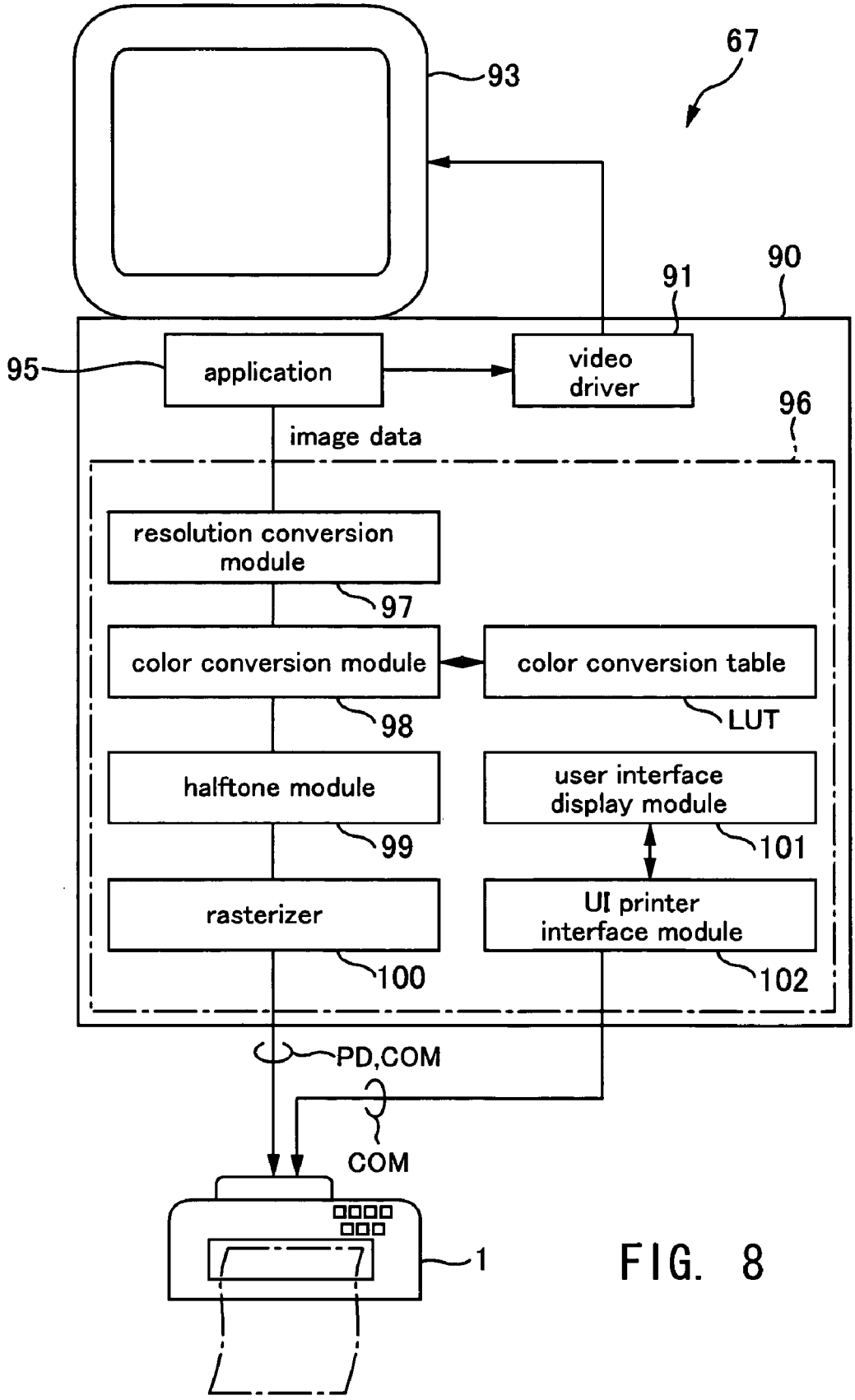
FIG. 8 is an explanatory diagram for describing processing on the host side.

FIG. 8 is a diagram for schematically describing the processing in the host 67. As shown in the diagram, the host 67 is provided with a main computer unit 90, which is connected to the printer 1, and a display device 93. A computer program 96 known as a "printer driver" for controlling operation of the printer 1 is installed in the main computer unit 90. As shown in the diagram, the printer driver 96 is operated by an application program 95 under a predetermined operating system that is installed on the host 67. The operating system includes a video driver 91 and a printer driver 96, and the application program 95 outputs print data PD for transfer to the inkjet printer 1 through these drivers. The application program 95, which carries out retouching of images, for example, performs desired processing with respect to an image to be processed, and also displays the image on the display device 93 via the video driver 91.

When the application program 95 issues a print command, the printer driver 96 of the main computer unit 90 receives image data from the application program 95 and converts these into print data PD to be supplied to the inkjet printer 1. The printer driver 96 is internally provided with a resolution conversion module 97, a color conversion module 98, a halftone module 99, a rasterizer 100, a user interface display module 101, a UI printer interface module 102, and a color conversion lookup table LUT.

The resolution conversion module 97 performs the function of converting the resolution of the color image data formed by the application program 95 to a print resolution, which is the mechanical resolution of the printer 1. For example, when the resolution of the color image data is not adapted to the print resolution of the printer 1, the resolution of the color image data is made to match the print resolution of the printer 1 by decimating the pixels of the color image data to reduce their number, or conversely by increasing the number of pixels by interpolation, for example.

The image data whose resolution is thus converted is image information still made of the three color components RGB. The RGB image data has a gradation value of 256 grades corresponding to the darkness of each of the RGB colors, for example, for each pixel.

Figure 9:
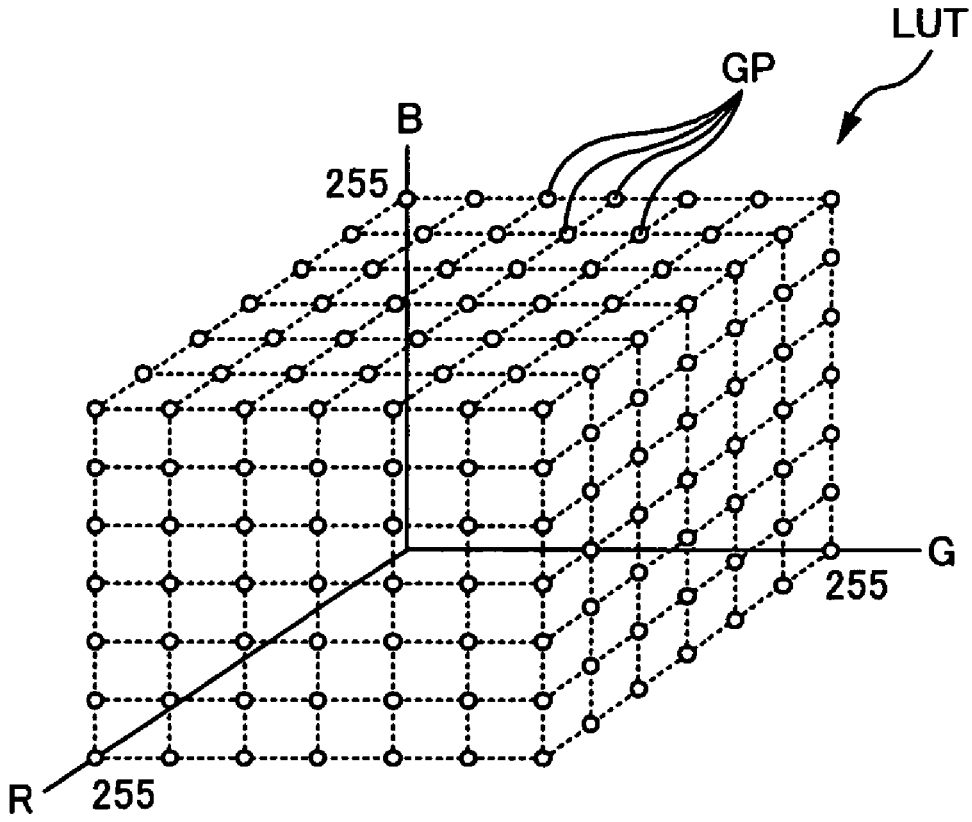
FIG. 9 is a conceptual diagram for describing a color conversion lookup table.

The color conversion module 98 references the color conversion lookup table LUT and for each pixel converts the RGB image data into multi-gradation data of the ink colors CMYK that can be used by the printer 1. FIG. 9 shows a conceptual diagram of the color conversion lookup table LUT. The lookup table LUT is a three-dimensional table in which the gradation values of R, G, and B are associated with three coordinate axes, and the value of each coordinate axis ranges from 0 to 255. At each of the 256×256×256 grid points GP of the table, gradation values for CMYK that correspond to the gradation values of RGB at that coordinate value are stored. Accordingly, by referencing a coordinate corresponding to the RGB gradation values of each pixel, corresponding CMYK gradation values can be immediately obtained. The CMYK multi-gradation data that have been thus obtained have a gradation value of 256 grades for each of the colors CMYK, for example.

The halftone module 99 executes so-called halftone processing with respect to the CMYK multi-gradation data, thereby creating halftone image data that are expressed in few levels-of-gray that can be expressed by the printer. That is, in the inkjet printer, the darkness of a color is expressed by adjusting the size and the number of dots formed on the paper S. Therefore, it is necessary to convert the CMYK multi-gradation data, which have 256 grades for each color, into image data that can be expressed by the size and the number of dots of that color. Halftone processing is the process of performing this conversion.

Figure 10:
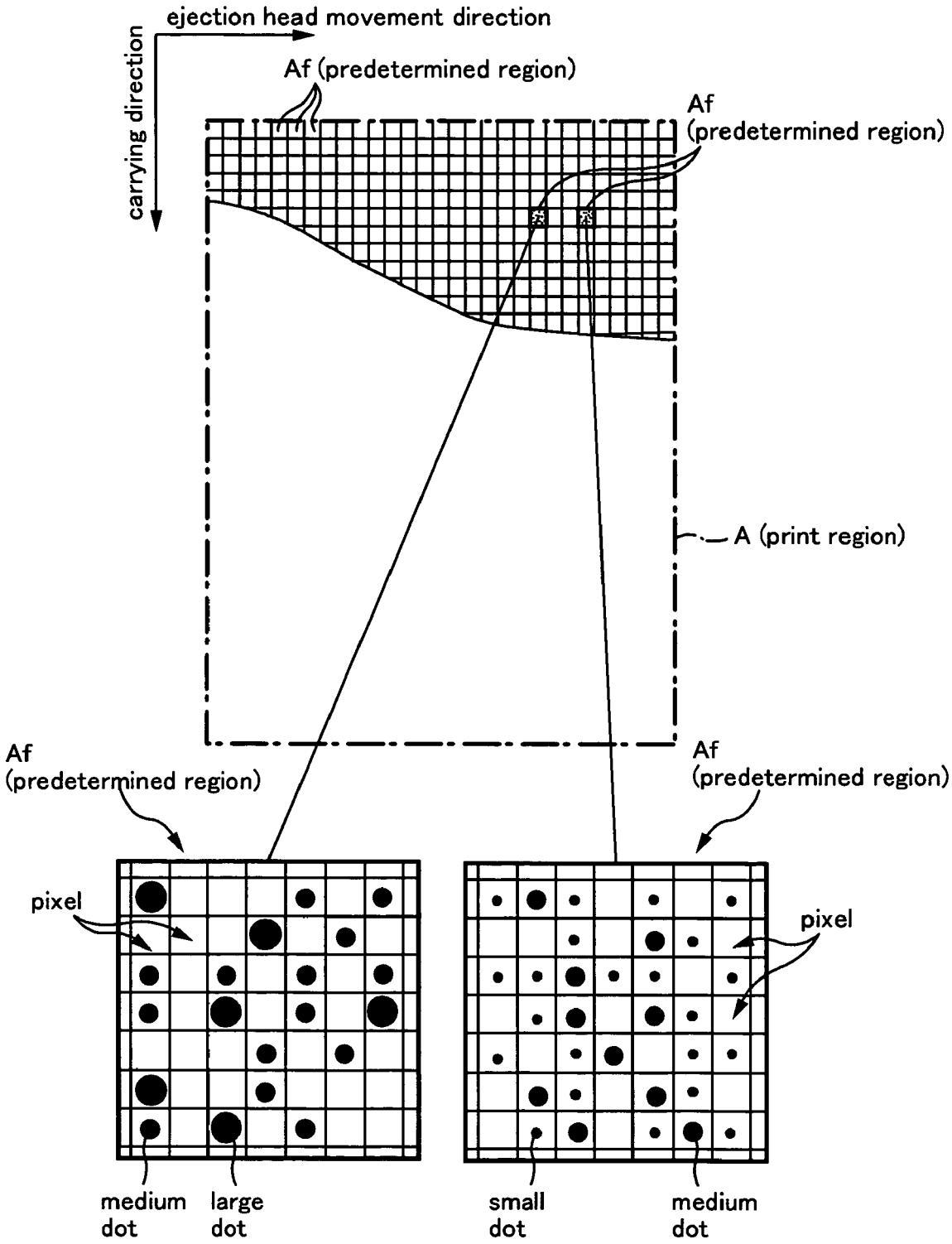
FIG. 10 is a conceptual diagram of a print region for describing halftone processing.

FIG. 10 is a conceptual diagram of a print region A for describing halftone processing, and the state in which dots are formed on the paper S based on the halftone image data is shown enlarged in one part of the diagram. As shown in FIG. 10, halftone processing is, for example, a process in which an image in the print region A is partitioned into predetermined regions Af made of a plurality of sites where pixels can be formed, and the darkness in each of the predetermined regions Af is expressed by whether a small dot, a medium dot, or a large dot is formed in the plurality of sites constituting that predetermined region Af.

Figure 11:
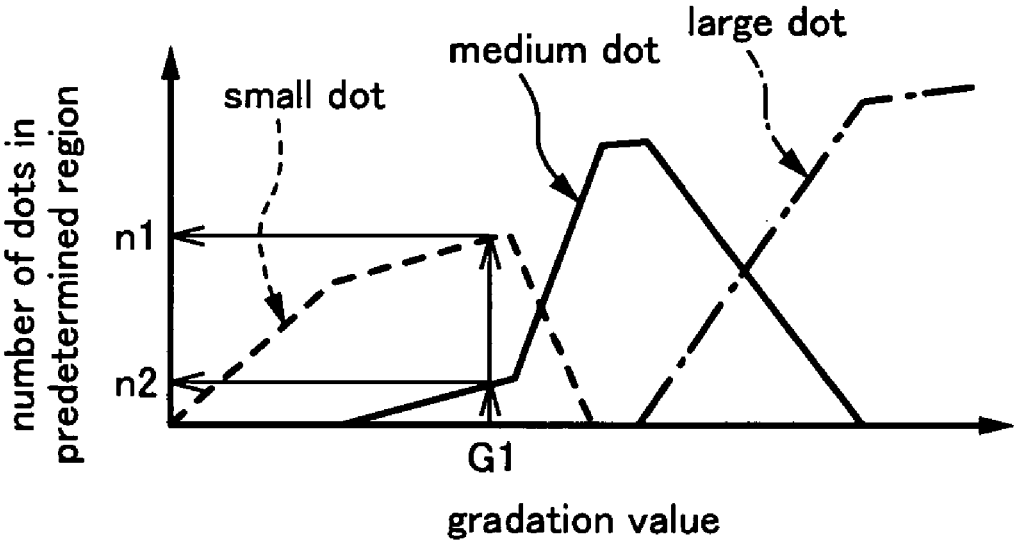
FIG. 11 is a conceptual diagram of a dot conversion graph that is used in the halftone processing.

Here, the ratio at which small, medium, and large dots are formed in each predetermined region Af is determined using the dot conversion graph as shown in FIG. 11. This dot conversion graph is prepared for each of the four colors CMYK. The horizontal axis of the graph is associated with the gradation value of each color and the vertical axis is associated with the number of dots required to express the gradation value with dots. It should be noted that the gradation value of the darkness in a predetermined region Af is determined based on the gradation values of pixels within that predetermined region Af.

In each predetermined region Af to be processed, the number of dots that corresponds to the gradation value of the darkness in that region is read for each dot size. Then, as shown in the enlarged diagram in FIG. 10, the same number of dots as the number of dots that has been read is assigned to pixels within the predetermined regions Af, thereby creating the halftone image data. For example, when the gradation value of cyan in a predetermined region Af, of the multi-gradation data for CMYK, is G1, as shown in FIG. 11, then n1 number of small dots and n2 number of medium dots are assigned to pixels within that predetermined region Af, so that the gradation value of the multi-gradation data is reproduced when viewed macroscopically.

This process of conversion from a gradation value into a dot is performed for the remaining colors of magenta, yellow, and black to create halftone image data from the multi-gradation data for CMYK.

The halftone image data thus created are arranged by the rasterizer 100 shown in FIG. 8 into the order by which they are to be transferred to the printer 1, and are output to the printer 1 as the final print data PD. The print data PD include raster data that indicates how dots are formed in each movement in the ejection head movement direction, and data indicating the sub-scan feed amount.

The user interface display module 101 has a function for displaying various types of user interface windows related to printing and a function for receiving input from the user through these windows.

The UI printer interface module 102 functions as an interface between the user interface (UI) and the printer 1. It interprets instructions given by users through the user interface and sends various commands COM to the printer 1, or conversely, it also interprets commands COM received from the printer 1 and performs various displays on the user interface.

It should be noted that the printer driver 96 executes, for example, a function for sending and receiving various types of commands COM and a function for supplying print data PD to the printer 1. A program for executing the functions of the printer driver 96 is supplied in a format in which it is stored on a computer-readable storage medium. Examples of this storage medium include various types of media from which the host 67 can read data, such as flexible disks, CD-ROMS, magneto optical disks, IC cards, ROM cartridges, punch cards, printed materials on which a code such as a bar code is printed, internal storage devices (memories such as a RAM or a ROM) and external storages devices of the host 67. The computer program can also be downloaded onto the main computer unit 90 via the Internet.

It should be noted that "liquid ejecting apparatus" means the printer 1 in a narrow sense, and means the system including the printer 1 and the main computer unit 90 in a broad sense.

Borderless Printing

"Borderless printing" is described below. "Borderless printing" is a method of printing in which margins are not formed at the edges of a print paper S. In the inkjet printer 1 according to this embodiment, by selecting the print mode it is possible to alternatively execute either "borderless printing" or "normal printing."

Figure 12:
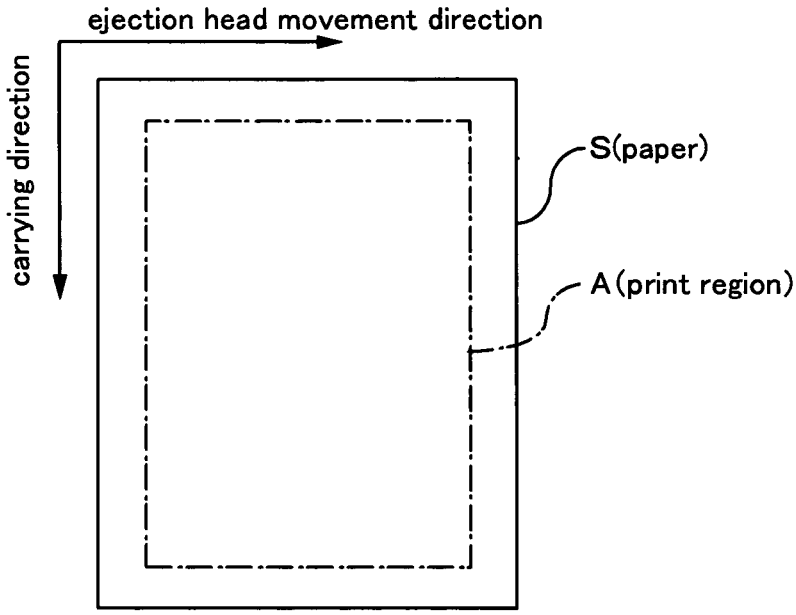
FIG. 12 is an explanatory diagram illustrating the relationship between the size of the print region and the paper during normal printing.

In "normal printing," printing is performed in such a manner that the print region A, which is the region onto which ink droplets are ejected, fits on the paper S. FIG. 12 shows the relationship between the sizes of the print region A and the paper S during "normal printing." The print region A is set to fit within the paper S, and thus margins are formed at the top and bottom edges and the left and right edges of the paper S.

When "normal print mode" is set as the print mode in order to perform the "normal printing," the printer driver 96 creates print data PD so that the print region A fits on the paper S based on image data received from the application program. For example, when processing image data in which the print region A does not fit within the paper S, a portion of the image that is expressed by the image data is disregarded when printing or that image is shrunken, for example, so that it fit on the paper S.

Figure 13:
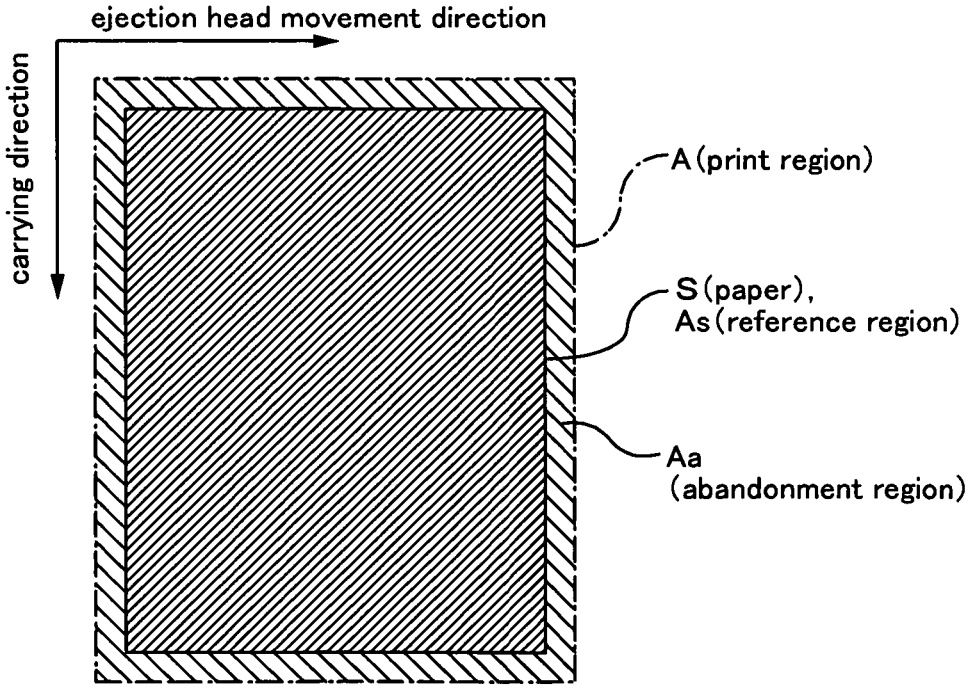
FIG. 13 is an explanatory diagram illustrating the relationship between the size of the print region and the paper during borderless printing.

FIG. 13 shows the relationship between the sizes of the print region A and the paper S during "borderless printing." The print region A is also set for a region that extends beyond the top and bottom edges and the left and right edges of the paper S (hereinafter, referred to the abandonment region Aa), and ink droplets are ejected onto this region as well. Thus, even when the position of the paper S is somewhat deviated with respect to the ejection head 21 as a result of the positioning accuracy when the paper is carried, for example, droplets of ink are reliably ejected toward the edges of the paper S to form dots, thereby keeping margins from being formed at the edges. It should be noted that "borderless printing" does not always have to be performed with respect to all of the top and bottom edges and the left and right edges of the paper S as shown in FIG. 13, and sometimes it may also be performed for only one of these edge portions.

When "borderless print mode" has been set as the print mode in order to perform "borderless printing," the printer driver 96 creates print data PD with which the print region A extends beyond the paper S by a predetermined width, based on the image data. For example, when processing image data in which the print region A is smaller than the paper S, the image is enlarged so that the print region A covers the entire paper S and extends beyond the paper S by the predetermined amount. Conversely, when processing image data in which the print region A extends significantly beyond the paper S, the image is shrunken so that the amount by which the print region extends beyond the paper S becomes the predetermined width. It should be noted that when performing adjustment through enlarging or shrinking in order to ensure the predetermined width, if the aspect ratio of the image is changed from that of the original image and distorted, a portion of the image may be eliminated from the object to be printed after scaling adjustment so that the predetermined width is secured while the aspect ratio of the original image is maintained.

Adjustment by scaling is described in detail. The printer driver 96 stores a region having the same size as the standard size of the paper S in the memory 65 as a reference region As. The printer driver 96 references the reference region As to generate print data PD by scaling the image data to a size where it extends outside the reference region As by the predetermined width in the ejection head movement direction and the carrying direction. The amount corresponding to the predetermined width is the region that is determined to be outside of the paper S, and is the abandonment region Aa in which ink droplets are abandoned.

The reference region As and the predetermined width are stored in the memory 65 for each paper size, such as postcard size and A4 size, and are read individually based on the paper size information that is input by a user and then used for the above-described scaling adjustment.

Incidentally, if paper carrying is performed correctly and the paper S precisely positioned in a predetermined design position, then the reference region As matches the paper S and the image in the reference region As is printed on the paper S. However, if the position of the paper S is deviated from the design position, then the image in the abandonment region Aa will be printed onto the edges of the paper S.

<Processing the Abandoned Ink>

In "borderless printing," abandoned ink droplets that land outside the paper S can have negative effects, such as adhering to the platen 14 and making it dirty. For this reason, the platen 14 of the printer 1 according to this embodiment is provided with an ink collecting section 80 for collecting ink droplets that have outside the paper S.

Figure 14:
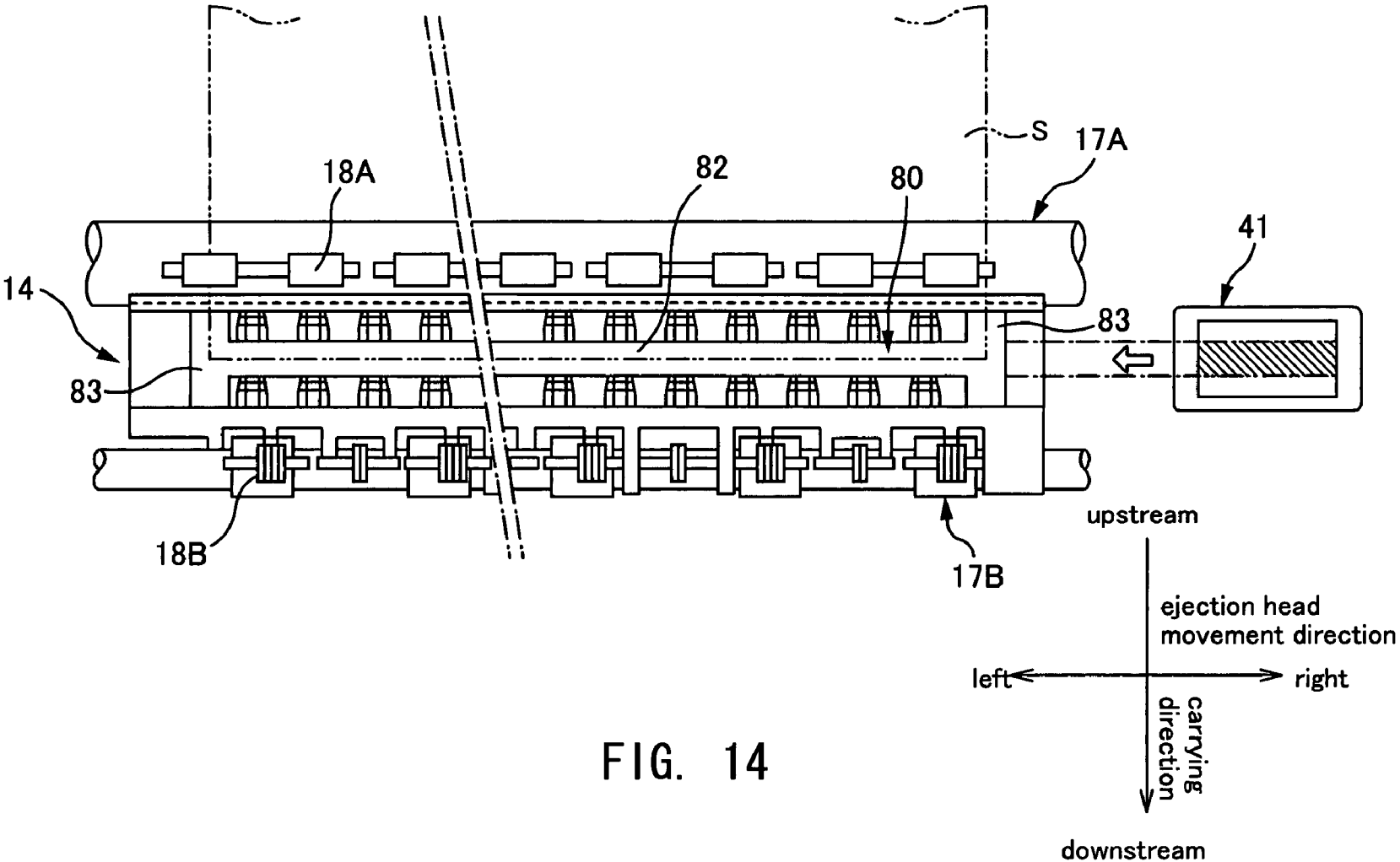
FIG. 14 is a plan view showing an ink collecting section.

FIG. 14 is a plan view of the ink collecting section 80. The ink collecting section 80 is broadly divided into two sections, these being a first ink collecting section 82 shown in the cross-sectional view of FIG. 15 and a second ink collecting section 83 shown in the cross-sectional view of FIG. 16. The first ink collecting section 82 is used when performing borderless printing with respect to the top and bottom edges of the paper S, and the second ink collecting section 83 is used when performing borderless printing with respect to the left and right side edges of the paper S.

Figure 15A:
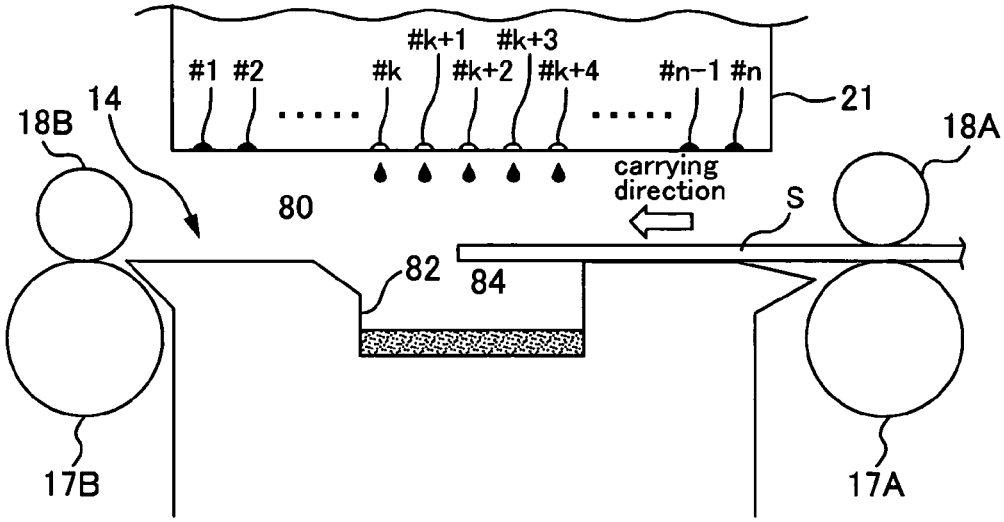
FIG. 15A is a cross-sectional view showing a first ink collecting section.
Figure 15B:
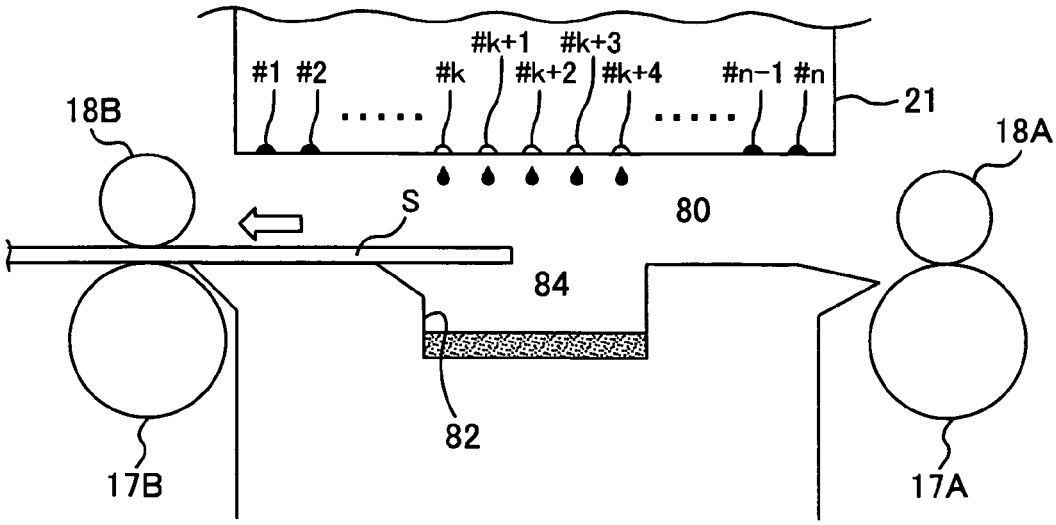
FIG. 15B is a cross-sectional view showing the first ink collecting section.
Figure 16:
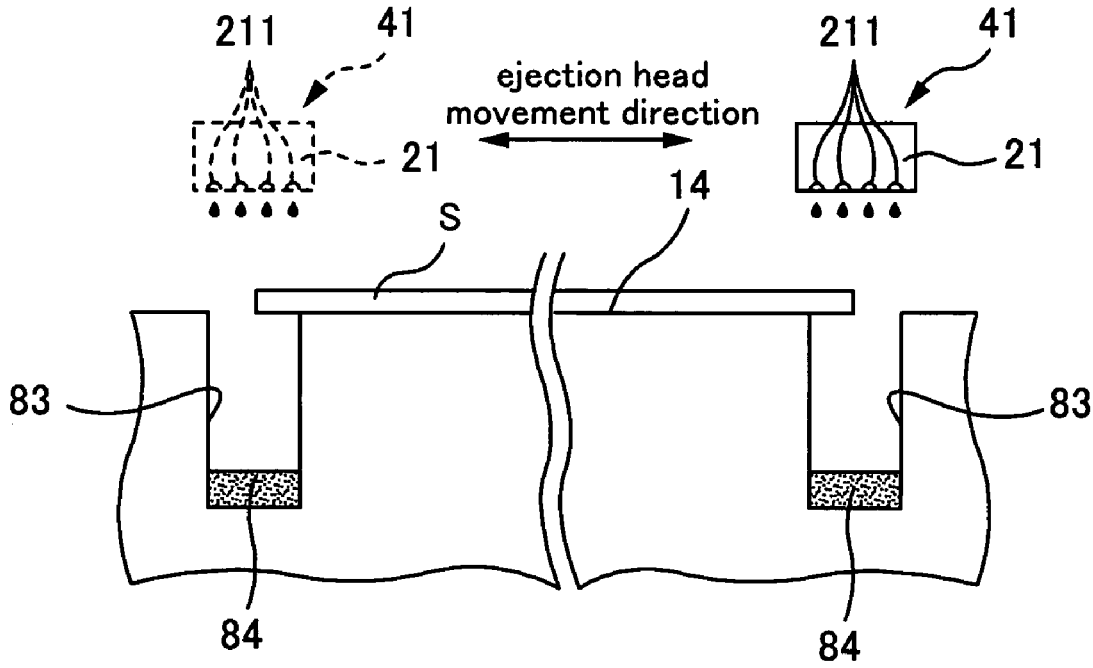
FIG. 16 is a cross-sectional view showing a second ink collecting section.

As shown in FIGS. 14 to 16, both of the first and second ink collecting sections 82 and 83 are formed in the platen 14 as grooves having a cross-sectional shape that is in the shape a depression. An absorbing member 84 such as a sponge for absorbing ink droplets is provided in the groove portions. The abandoned ink droplets reach the top of the absorbing member 84 and are absorbed by the absorbing member 84. It should be noted that the first and the second ink collecting sections 82 and 83 correspond to the recessed sections of the claims, and the protruding sections of the claims are the sections in the upper surface of the platen 14 other than the recessed sections.

The groove portion of the first ink collecting section 82 shown in FIGS. 14 and 15 is provided in a straight line in the movement direction (ejection head movement direction) of the carriage 41, and the position of the groove in the carrying direction is in opposition to substantially the center part of the ejection head 21; that is, it is in opposition to nozzles #k to #k+4. Consequently, when borderless printing is performed with respect to the top edge portion as shown in FIG. 15A, ink droplets are ejected only from the nozzles #k to #k+4 prior to the top edge of the paper S arriving at the first ink collecting section 82. On the other hand, when borderless printing is performed with respect to the bottom edge, then, as shown in FIG. 15B, ink droplets are ejected only from the nozzles #k to #k+4 after the bottom edge of the paper S has passed over the first ink collecting section 82. Then, while printing these top and bottom edges, ink droplets that have not landed on the paper S, among the ink droplets ejected from the nozzles #k to #k+4, land on the absorbing member 84 in the first ink collecting section 82, and thus the upper surface of the platen 14 is effectively prevented from becoming dirty due to these abandoned ink droplets.

Further, the groove portions of the second ink collecting section 83 shown in FIGS. 14 and 16 are provided at positions where they are in opposition to the left and right edge portions of the paper S, and both of these groove portions are formed in straight lines in the carrying direction of the paper S. When borderless printing is performed with respect to the left and right edges, ink droplets are ejected from nozzles during movement of the carriage head 41 in the ejection head movement direction not only when the carriage 41 is moving over the print paper S but also when it is moving over the abandonment region Aa outside the side edges of the paper. Here, ink droplets ejected onto the abandonment region Aa land on the absorbing member 84 in the second ink collecting sections 83, so that the platen 14 is effectively prevented from becoming dirty due to these abandoned ink droplets.

Regarding the Magnitude (Size) of Ink Droplets Ejected Onto the Abandonment Region Aa In "borderless printing," ink droplets are also ejected toward the abandonment region Aa as described above. However, it is more difficult for the ink droplets to reach the ink collecting section 80, which is where they land, than when ejected toward the paper S. The reason for this is that the ink collecting section 80 is positioned farther from the nozzles than the paper S, so that the ink droplets travel a long distance to the landing point and thus are prone to lose speed during the flight due to air resistance, for example.

Moreover, such a drop in speed is prone to occur particularly when the size of ink droplets is small. This is because small-sized ink droplets have a small mass, for example. Small-sized ink droplets that have lost speed before reaching the ink collecting section 80 may adhere to a portion other than the ink collecting section 80, such as the upper surface of the platen 14, after being floated due to the airflow or the static electricity, for example, inside the printer 1.

Accordingly, in the present invention, the small ink droplets, which are the smallest size that the nozzles can eject, are kept from being ejected toward the abandonment region Aa as will be described below. In other words, in this embodiment, the print data PD are generated in such a manner that only medium ink droplets are ejected toward the abandonment region Aa. In this case, the main host computer unit 90 that creates the print data PD corresponds to the "controller for controlling ejection of the liquid droplets from the liquid ejecting section" in the claims.

Figure 17:
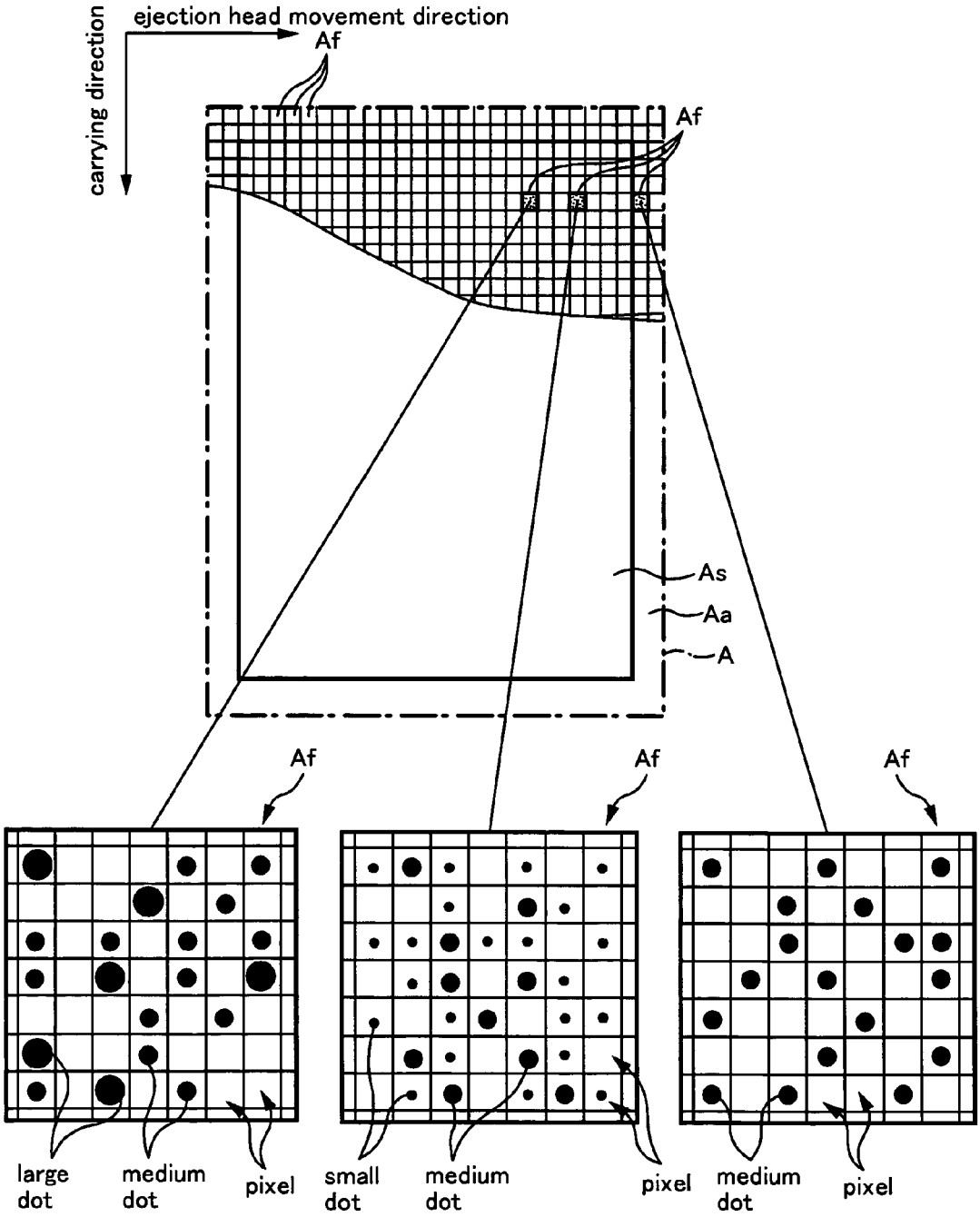
FIG. 17 is an explanatory diagram for describing the size of the ink droplets that are ejected toward an abandonment region.

FIG. 17 shows the print region A of an image that is printed according to the print data PD. It should be noted that the square grids shown in the upper half of the print region A in the diagram are the predetermined regions Af mentioned above in the description of halftone processing. In the lower half of the diagram, several predetermined regions Af are selected from the reference region As and the abandonment region Aa and shown enlarged so that the manner in which dots are formed within the predetermined regions Af can be understood. It should be noted that the square grids shown in these enlarged diagrams represent pixels.

As shown in these enlarged views, the image in the reference region As is made of small, medium, and large dots, whereas the image in the abandonment region Aa is made of only medium dots, which can be formed by medium ink droplets. The reason behind this is to prevent ink droplets from floating by keeping small ink droplets from being ejected toward the abandonment region Aa as described above.

It should be noted that, here, it is obvious why small dots are not used for the image in the abandonment region Aa, but the reason for not using large dots either is that large dots in this embodiment are formed by combining a small ink droplet and a medium ink droplet. That is, the reason is that when forming large dots, small ink droplets are also ejected and these small ink droplets may become suspended. Therefore, if the large dots are not formed using small ink droplets, then the image in the abandonment region Aa could be made of large dots. For example, there is no problem if large dots are formed using ink droplets that are larger in size than the medium ink droplets, or if large dots are formed by ejecting medium ink droplets a plurality of times.

A method for forming the image in the abandonment region Aa using only of medium dots while forming the image in the reference region As using small, medium, and large dots is described below.

This method is achieved by refining the halftone processing for converting the multi-gradation data for CMYK into data for dots. As described above, halftone processing is processing in which an image with CMYK multi-gradation data that have been converted using the color conversion lookup table LUT is partitioned into predetermined regions Af, and in each predetermined region Af, a number of small, medium, and large dots that corresponds to the darkness in that region are arranged in a dispersed manner. At this time, the dot conversion graph is used to determine the number of dots to be arranged in the predetermined regions Af. In this embodiment, separate dot conversion graphs are provided for the reference region As and the abandonment region Af.

Figure 18A:
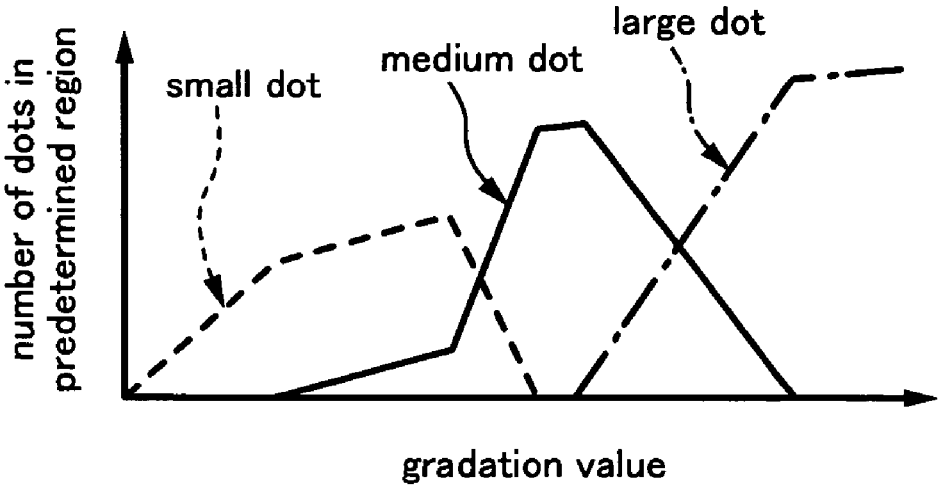
FIG. 18A is a dot conversion graph for a reference region.
Figure 18B:
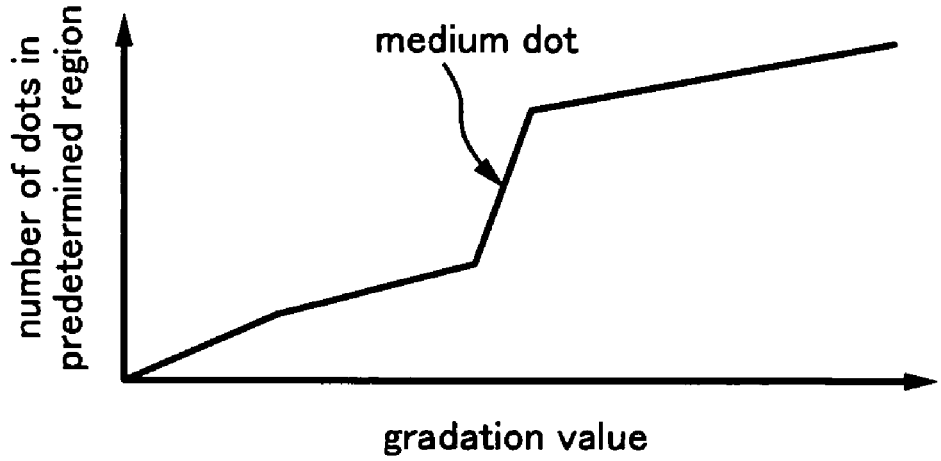
FIG. 18B is a dot conversion graph for the abandonment region.

FIG. 18A shows a dot conversion graph for the reference region As, and FIG. 18B shows a dot conversion graph for the abandonment region Aa. It should be noted that the dot conversion graph for the reference region As is the same as the graph in FIG. 11.

In both drawings, the horizontal axis indicates the gradation value and the vertical axis indicates number of dots to be arranged in a predetermined region Af. In the graph for the reference region As, the relationship between the gradation value and the number of dots is indicated for each dot size of small, medium, and large because in the reference region As the gradation values in the predetermined regions Af are expressed by using small, medium and large dots. In contrast, in the graph for the abandonment region Aa, the relationship between the gradation value and the number of dots is indicated only for medium dots because in the abandonment region Aa the gradation values in the predetermined regions Af are expressed by using only medium dots. It should be noted that the relationship between the gradation value and the number of dots is preset so that, when the number of dots derived from this relationship is dispersed among the pixels in a predetermined region Af, a person who observes this macroscopically perceives a darkness at the gradation value in the predetermined regions Af.

Figure 19:
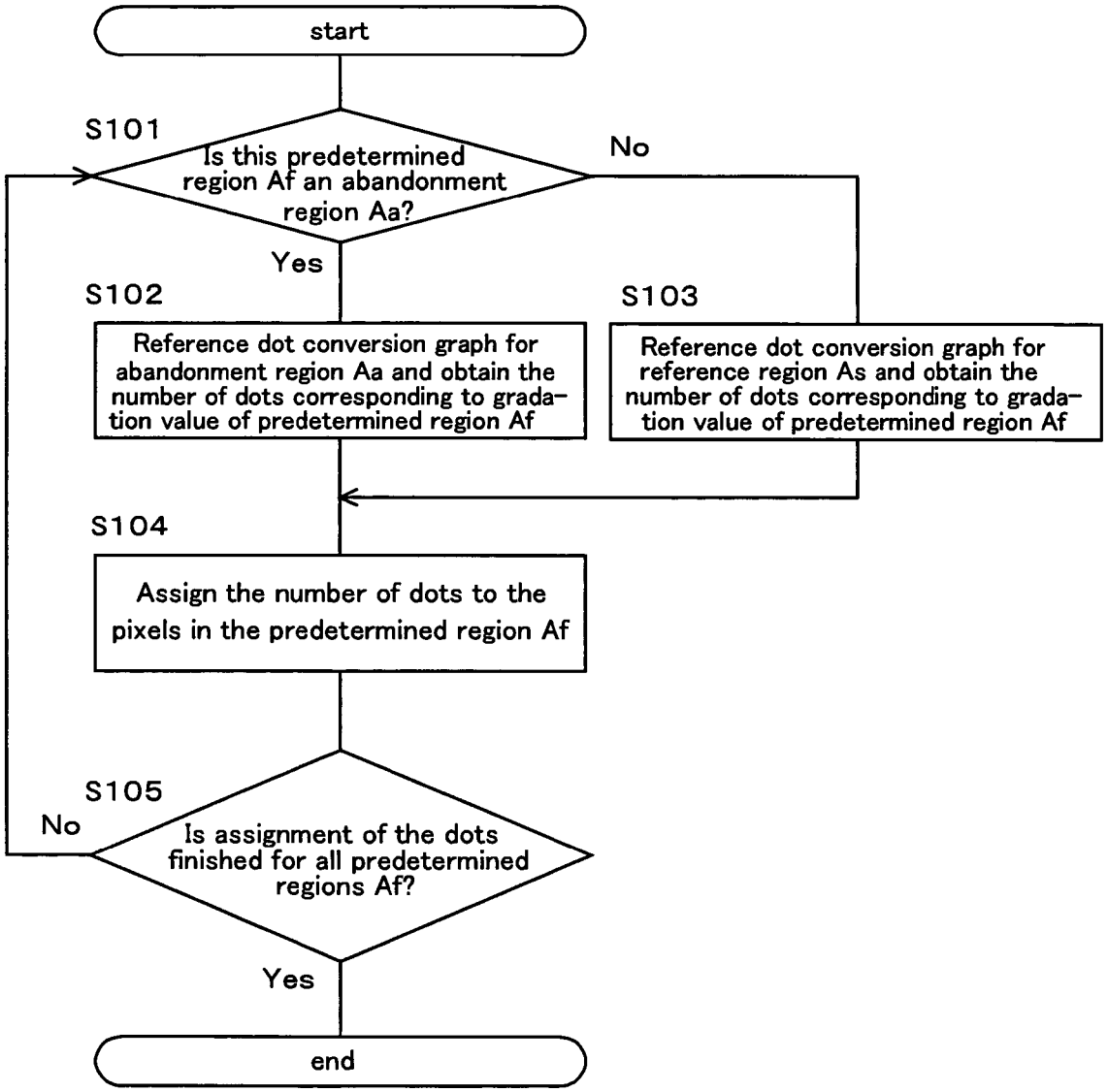
FIG. 19 is a flowchart of the halftone processing.

Here, the flow of halftone processing executed by the halftone module 99 using such dot conversion graphs is described with reference to the flowchart in FIG. 19.

First, the halftone module 99 determines whether or not a predetermined region Af to be processed is the abandonment region Aa (step S101). If the predetermined region Af is the reference region As, then the halftone module 99 references the graph for the reference region As shown in FIG. 18A to obtain the number of small, medium, and large dots that correspond to the gradation value in the predetermined region Af (step S103), and then assigns that number of dots to the pixels in the predetermined region Af (step S104). On the other hand, if in step S101 the predetermined region Af is the abandonment region Aa, then the halftone module 99 references the graph for the abandonment region Aa shown in FIG. 18B and obtains the number of medium dots that corresponds to the gradation value of that predetermined region Af (step S102), and then assigns the obtained number of dots to the pixels of the predetermined region Af (step S104).

The halftone module 99 performs halftone processing sequentially from one end to the other end in the ejection head movement direction for the predetermined regions Af in the first row of the print region A, for example, and when that row is finished, the procedure advances one row in the carrying direction and halftone processing is then executed for the predetermined regions Af of the second row. This procedure is repeated until the final row, thereby performing halftone processing for all of the predetermined regions Af in the print region A to create halftone image data. The halftone module 99 then sends the halftone image data to the rasterizer 100, and the rasterizer 100 arranges these data into the order in which they are to be transferred to the printer 1 to create the print data PD.

First Modified Example

In the embodiment described above, the image in the abandonment region Aa was made of medium dots only. However, in this case, the boundary area between the abandonment region Aa and the reference region As, in which the image is made of small, medium, and large dots, may appear discontinuous. In other words, since the dots making up the image change abruptly at this boundary area, the graininess of the image significantly changes and may appear unnatural.

Figure 20:
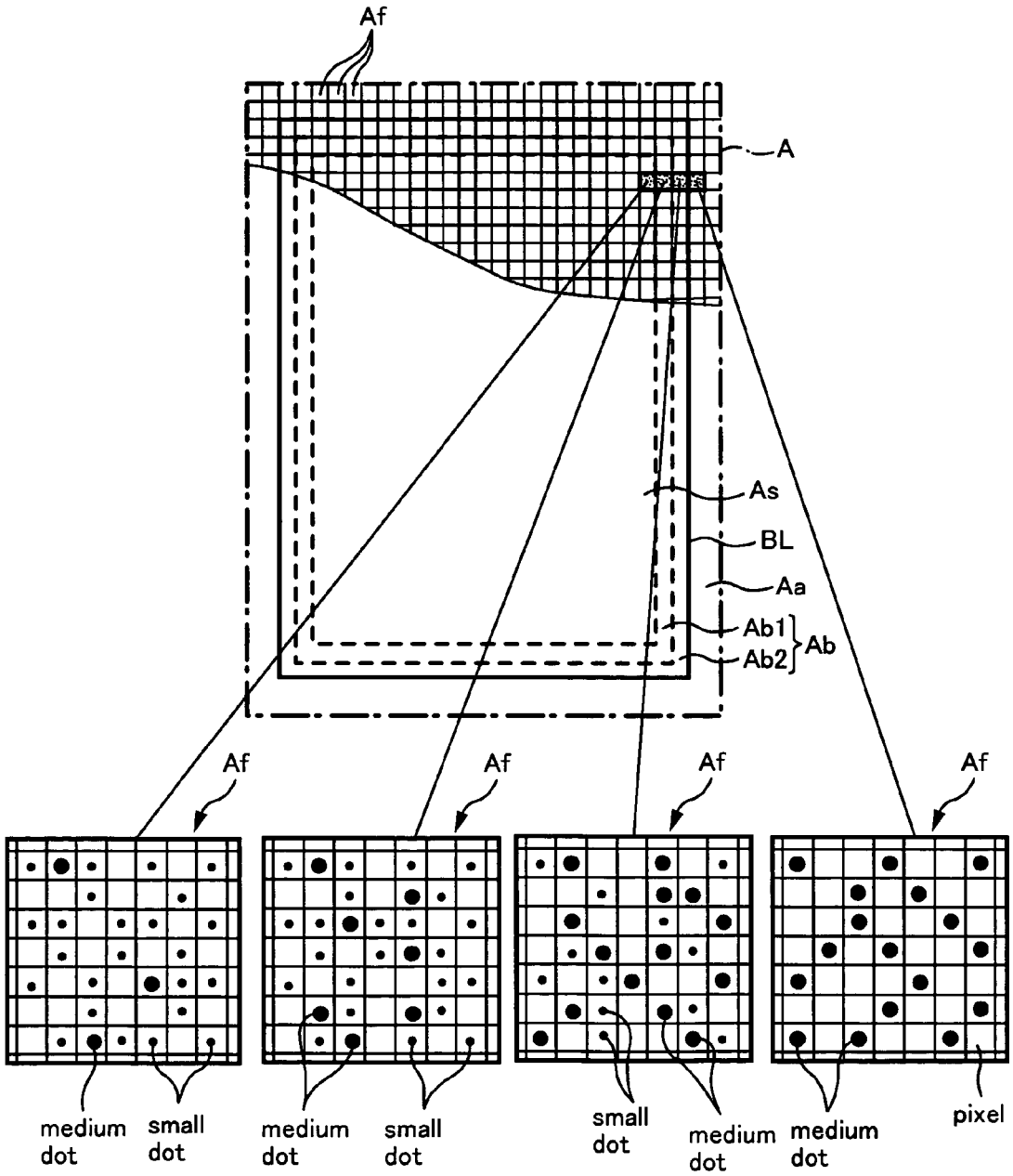
FIG. 20 is an explanatory diagram for describing a first modified example.

For this reason, in the first modified example, a buffer region Ab having a predetermined width is provided as a frame at a portion that is along but inside a boundary line BL between the abandonment region Aa and the reference region As as shown in FIG. 20. Within the buffer region Ab, the proportion of medium dots is gradually increased from the inside of that region toward the outside. It should be noted that here the reason for providing the buffer region Ab within the reference region As, which is inside of the boundary line BL, instead of providing it within the abandonment region Aa is because small ink droplets are ejected in the buffer region Ab to form small and large dots therein.

The buffer region Ab is described in detail below. The buffer region Ab is further internally divided into a plurality of frame-like regions Ab1 and Ab2. In the example shown in the drawing, it is divided into two regions, these being a first buffer region Ab1 that is positioned on the reference region As side and a second buffer region Ab2 that is positioned on the abandonment region Aa side. A graph having a larger number of medium dots and a smaller number of small and large dots than in the dot conversion graph for the reference region As is prepared as the dot conversion graph for the first buffer region Ab1. Also, a graph having an even larger number of medium dots and even fewer small and large dots is prepared for the second buffer region Ab2 on the outer side. Then, by performing halftone processing using these dot conversion graphs, the proportion of medium dots is increased in two stages from the inside toward the outside of the buffer region Ab.

The lower half of FIG. 20 shows a magnified view of four contiguous predetermined regions Af lined up from reference region As toward the abandonment region Aa, and it can be understood that the proportion of medium dots increases gradually from the reference region As toward the abandonment region Aa by way of the first buffer region Ab1 and the second buffer region Ab2.

It should be noted that the number of internal divisions of the buffer region Ab is not limited to two as described above, and from the perspective of gradually changing the proportion of medium dots, the greater the number of internal divisions the better.

Second Modified Example

In the foregoing embodiment, the dot conversion graphs that are used in halftone processing were prepared for both the reference region As and the abandonment region Aa. However, in this case, it is necessary to reference the corresponding dot conversion graph for every predetermined region to be processed, and thus there is a possibility that the processing rate may become slow.

In contrast, in this second modified example, a normal dot conversion graph for the reference region As is used for to the entire surface of the print region A instead of using a separate dot conversion graph for the abandonment region Aa. That is, in halftone processing, halftone image data made of small, medium, and large dots are temporarily generated for the entire surface of the print region A without distinguishing between the reference region As and the abandonment region Aa, and then, data for large and small dots of the abandonment region Aa in the halftone image data are mechanically replaced by data for medium dots (hereinafter, this is referred to as replacement processing). Thus, the rate at which halftone processing proceeds is increased.

Figure 21:
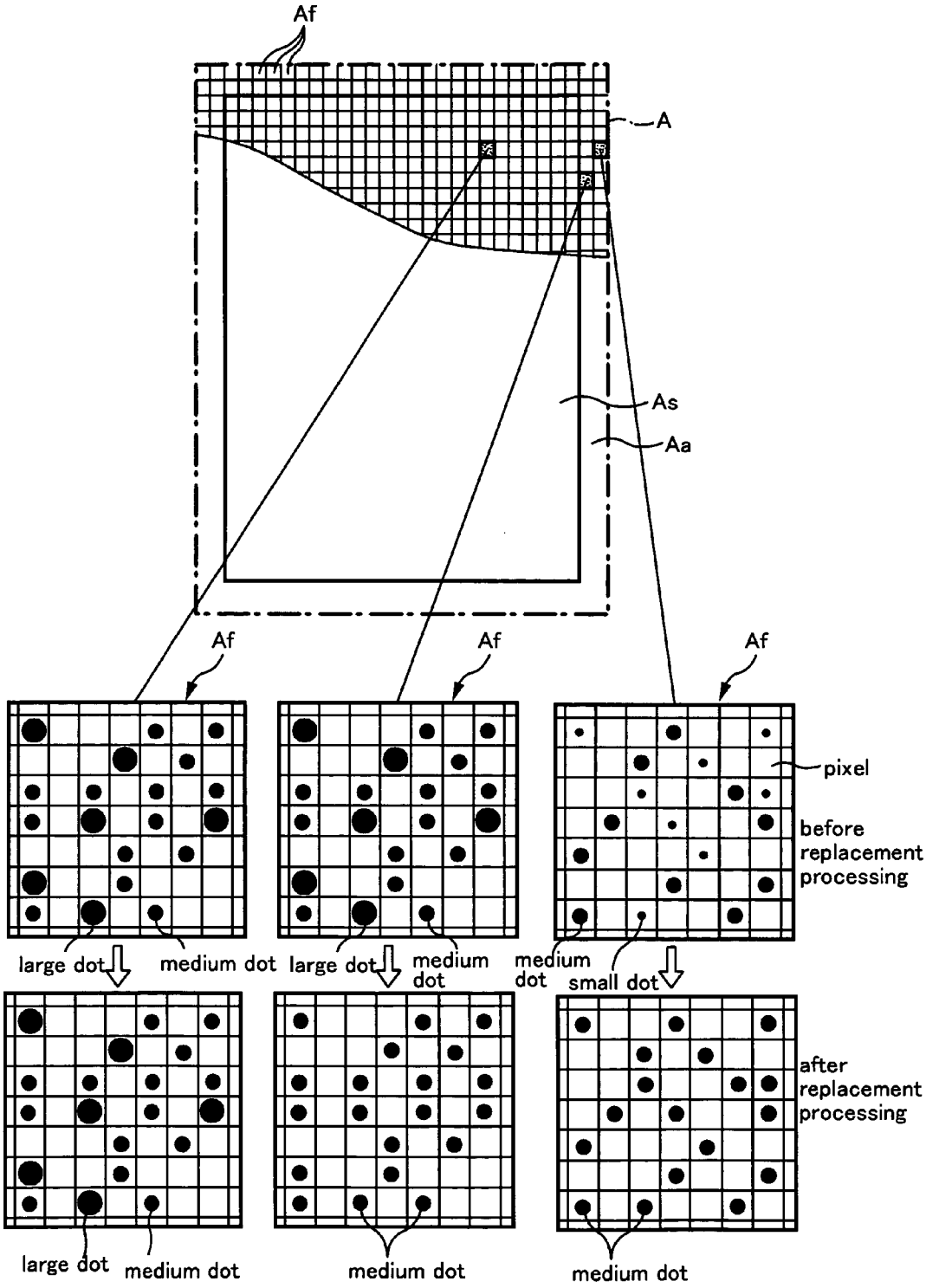
FIG. 21 is an explanatory diagram for describing a second modified example.

FIG. 21 is a diagram for describing replacement processing, and shows how dots of the halftone image data are altered by replacement processing. It should be noted that the expression format of this diagram is the same as in FIG. 17.

As shown by the magnified view of FIG. 21, the predetermined regions Af in the abandonment region Aa, and of course the reference region As, are made of small, medium, and large dots prior to replacement processing. However, after replacement processing, the small and large dots in the abandonment region Aa have been replaced by medium dots. Thus, only medium ink droplets are for the abandonment region Aa, and small ink droplets, which are the smallest ink droplets, are kept from being ejected.

Figure 22:
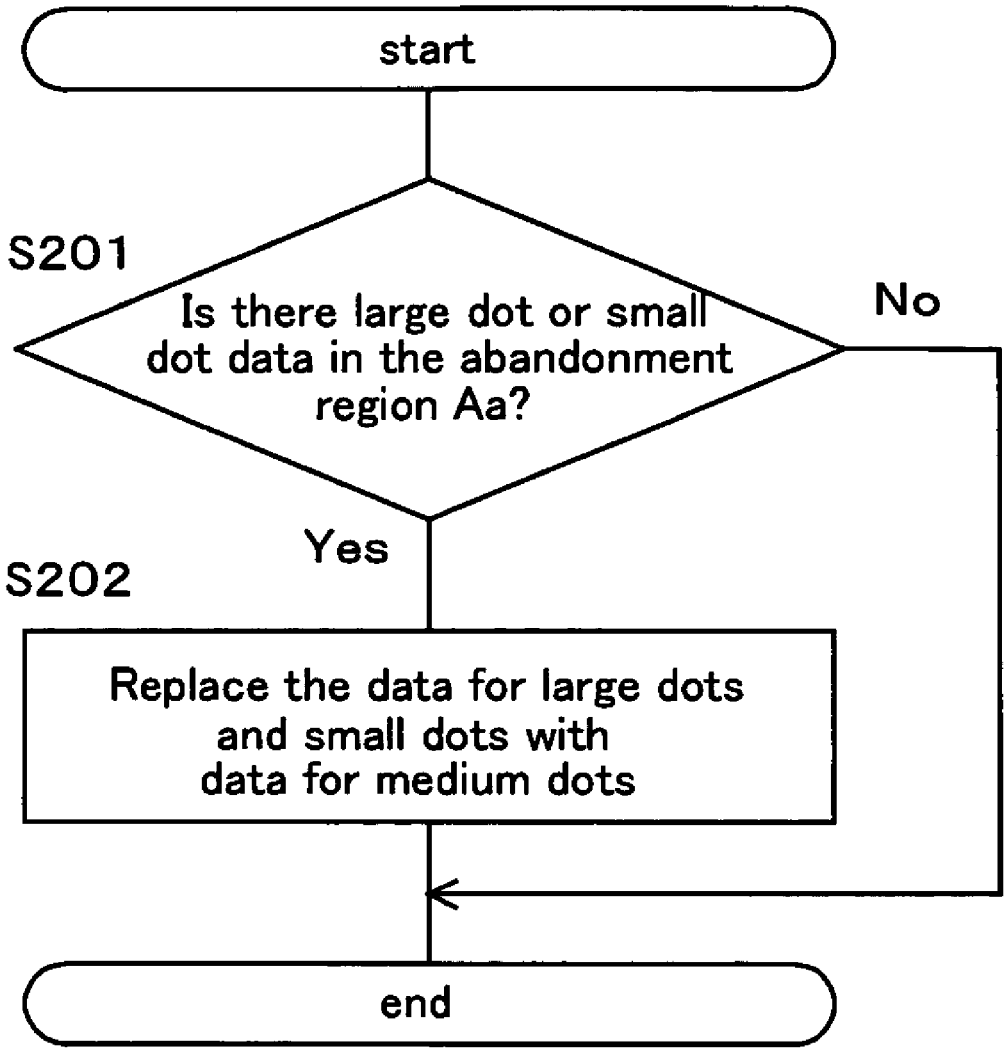
FIG. 22 is a flowchart of the replacement process according to the second modified example.

Such replacement processing is performed by a replacement processing module, which is not shown, with respect to the halftone image data before they are rasterized by the rasterizer 100. The replacement processing module is provided in the printer driver 96 described above and executes the procedure of the flowchart shown in FIG. 22. Then, it transmits the halftone image data for which replacement processing has finished to the rasterizer 100.

It should be noted that the timing at which the replacement processing is performed is not limited to immediately after the halftone processing, and it may also be performed after conversion to raster data by the rasterizer 100.

Also, if it is sufficient to suppress rather than entirely preventing the floating of ink droplets, then in such a case, it is not necessity to replace all the large and small dots of the abandonment region Aa in the halftone image data with medium dots, and a suppressing effect can be achieved even when only some are replaced.

It should be noted that the main host computer unit 90 for operating the printer driver 96 provided with the replacement processing module corresponds to the "controller for controlling ejection of the liquid droplets from the liquid ejecting section" of the claims.

OTHER EMBODIMENTS

In the foregoing, the liquid ejecting apparatus of this embodiment was described taking an inkjet printer as an example. However, the foregoing embodiment is for the purpose of elucidating the present invention and is not to be interpreted as limiting the present invention. The invention can of course be altered and improved without departing from the gist thereof and includes functional equivalents. In particular, the embodiments described below are also included in the liquid ejecting apparatus according to the present invention.

In this embodiment, some or all of the configurations achieved by hardware may be replaced by software, and conversely, some of the configurations that are achieved by software can be replaced by hardware.

The medium also may be cloth and film, for example, in addition to the print paper S.

It is possible to perform some of the processes that are performed on the liquid ejecting apparatus side on the host side instead, and it is also possible to provide a dedicated processing device between the liquid ejecting apparatus and the host, and perform some of the processes using this processing device.

Moreover, in this embodiment, in order to perform borderless printing, the abandonment region Aa that is determined to be outside the print paper S is established outside the paper S, and small ink droplets, which are the smallest size, are kept from being ejected to the region Aa, as shown in FIG. 13. However, this is not a limitation.

For example, by setting the print region A in FIG. 13 to substantially the same size as the paper S, the invention can also be adopted for a case in which borderless printing is performed without providing an abandonment region Aa. That is, if the position of the paper S has not deviated from a set design position when the paper is carried, then all the ink droplets land on the paper S without any ink droplets being abandoned, but if its position has deviated, then abandoned ink droplets that go outside of and that do not land on the paper S will be generated. As regards the ink droplets that are abandoned at this time, it is also possible to allow only medium ink droplets to be ejected so as to keep small ink droplets from being ejected. It should be noted that in this case, ink droplets that are ejected toward portions more inward than the edges of the paper S are set to be medium ink droplets, and this concept is also included in the scope of the invention according to claim 1.

<Regarding the Liquid Ejecting Apparatus>

The liquid ejecting apparatus of the present invention can be adopted for printing apparatuses such as an inkjet printer as described above, and in addition to these it also can be adopted for color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices, for example.

<Regarding the Liquid>The liquid of the present invention is not limited to ink, such as dye ink or pigment ink, as described above, and it is also possible to adopt liquids (including water) including metallic material, organic material (particularly macromolecular material), magnetic material, conductive material, wiring material, film-formation material, electric ink, processed liquid, and genetic solutions, for example. Moreover, as regards the constituents of the liquid, the solvent may be dissolving agents in addition to water, which constitutes the liquid.

<Regarding the Medium>

As regards the medium, it is possible to use regular paper, matte paper, cut paper, glossy paper, roll paper, paper, photographic paper, and rolled photographic paper, for example, as the paper S described above. In addition to these, it is also possible to use film material such as OHP film or glossy film, cloth material, and sheet metal material, for example. In other words, any medium may be used, as long as liquid can be ejected onto it.

<Regarding the Nozzle Rows>

The nozzle rows provided in the ejection head are not limited to the above-described four rows of black (K), cyan (C), magenta (M), and yellow (Y), and a nozzle row for ejecting ink of a color other than these colors may be further provided therein. For example, a nozzle row for ejecting clear ink, which is transparent ink, may also be provided therein.

According to the present embodiment, it is possible to prevent liquid droplets that are ejected toward a region that is outside of a medium from floating and inhibit liquid droplets from thus adhering to unanticipated sites when ejecting droplets of liquid to form dots over the entire medium up to its edges.

What is claimed is:

1. A liquid ejecting method comprising the following steps of:

preparing a medium; and ejecting liquid droplets of a plurality of sizes toward said medium that has been prepared;

wherein liquid droplets of the smallest size, among said liquid droplets of said plurality of sizes, are not included in the liquid droplets that are outside of and that do not land on said medium, and wherein the liquid droplets of the smallest size are not ejected when at least one or more liquid droplets are ejected toward a region that is determined to be outside of said medium.

2. A liquid ejecting method according to claim 1, wherein:

said liquid droplets are ejected in accordance with a plurality of drive signals that are prepared corresponding respectively to the sizes of said liquid droplets; and said liquid droplets of the smallest size are liquid droplets of a size that corresponds to a predetermined type of drive signal among said drive signals.

3. A liquid ejecting method according to claim 1, wherein:

said liquid droplets are ejected in accordance with image data formed at a size larger than said medium, and a reference region corresponding to a size of said medium is stored in a memory; and said region that is determined to be outside of said medium is a region that is outside of said reference region.

4. A liquid ejecting method according to claim 3, wherein an edge section having a predetermined width is established within said reference region along an outline of said reference region, and a proportion of said liquid droplets of the smallest size, among the liquid droplets that are ejected toward said edge section, decreases toward the outside in the direction of said width.

5. A liquid ejecting method according to claim 3, wherein data for ejecting liquid droplets other than said liquid droplets of the smallest size are recorded on a section of said image data that corresponds to said region that is outside of said reference region.

6. A liquid ejecting method according to claim 1, wherein:

said medium is supported by a support member when the liquid droplets that are ejected from said liquid ejecting section land on said medium; and a recessed section is formed in said support member in correspondence with a region that is determined to be outside of said medium, and said medium is supported by a protruding section of said support member.

7. A liquid ejecting method according to claim 1, wherein said liquid droplets are ink droplets.

8. A liquid ejecting method comprising the following steps of:

preparing a medium; and ejecting liquid droplets toward said medium that has been prepared;

wherein liquid droplets that have been changed from a smallest size to a larger size and ejected are included in the liquid droplets that are outside of and that do not land on said medium, and wherein, when liquid droplets of the smallest size are to be ejected toward a region that is determined to be outside of said medium, at least one of said liquid droplets of the smallest size that are to be ejected is changed to a liquid droplet of a larger size and ejected.

9. A liquid ejecting apparatus comprising:

a liquid ejecting section for ejecting liquid droplets of a plurality of sizes toward a medium; and a controller for controlling ejection of the liquid droplets from said liquid ejecting section;

wherein said controller controls ejection of the liquid droplets from said liquid ejecting section such that liquid droplets of the smallest size, among said liquid droplets of said plurality of sizes, are not included in the liquid droplets that are outside of and that do not land on said medium, and wherein the liquid droplets of the smallest size are not ejected when at least one or more liquid droplets are ejected toward a region that is determined to be outside of said medium.

10. A liquid ejecting apparatus comprising:

a liquid ejecting section for ejecting liquid droplets of a plurality of sizes toward a medium; and a controller for controlling ejection of the liquid droplets from said liquid ejecting section;

wherein said controller controls ejection of the liquid droplets from said liquid ejecting section such that liquid droplets that have been changed from the smallest size to a larger size and ejected are included in the liquid droplets that are outside of and that do not land on said medium, and wherein, when liquid droplets of the smallest size are to be ejected toward a region that is determined to be outside of said medium, at least one of said liquid droplets of the smallest size that are to be ejected is changed to a liquid droplet of a larger size and ejected.

11. A liquid ejecting system comprising:

a main computer unit; and a liquid ejecting apparatus that is connected to said main computer unit in a manner that allows for communication therebetween;

wherein said liquid ejecting apparatus is provided with a liquid ejecting section for ejecting liquid droplets of a plurality of sizes toward a medium in accordance with data that is received from said main computer unit; and wherein, when the liquid droplets are to be ejected from said liquid ejecting section toward said medium, said liquid ejecting apparatus receives data of a configuration according to which liquid droplets of the smallest size, among said liquid droplets of said plurality of sizes, are not included in the liquid droplets that are outside of and that do not land on said medium.

* * * * *